US006353717B1

(12) United States Patent
Suzuki

(10) Patent No.: US 6,353,717 B1
(45) Date of Patent: Mar. 5, 2002

(54) RECORDING APPARATUS AND METHOD FOR HANDLING DIFFERENT TYPES OF RECORDING MEDIUM

(75) Inventor: Nobuhiro Suzuki, Kawauchi-gun (JP)

(73) Assignee: Matsushita Graphic Communication Systems, Inc., Tokyo (JP)

( * ) Notice: Subject to any disclaimer, the term of this patent is extended or adjusted under 35 U.S.C. 154(b) by 0 days.

(21) Appl. No.: 09/697,326

(22) Filed: Oct. 27, 2000

(30) Foreign Application Priority Data

Nov. 4, 1999 (JP) ..... 11-313466

(51) Int. Cl.[7] ..... G03G 15/00; G03C 21/00
(52) U.S. Cl. ..... 399/45; 399/405
(58) Field of Search ..... 399/45, 361, 364, 399/405

(56) References Cited

U.S. PATENT DOCUMENTS 5,610,700 A * 3/1997 Yoshizuka ..... 399/45
5,809,392 A * 9/1998 Tabuchi et al. ..... 399/405
6,002,906 A * 12/1999 Hino et al. ..... 399/45 X

FOREIGN PATENT DOCUMENTS

JP 8-248711 * 9/1996
JP 9-265214 * 10/1997

* cited by examiner

*Primary Examiner*—Fred L Braun
(74) *Attorney, Agent, or Firm*—Greenblum & Bernstein P.L.C.

(57) ABSTRACT

When an instruction to perform both-side recording for recording an image on each of both sides of a recording medium is input, it is determined whether the recording medium to be subjected to image recording is a water-repellent sheet that repels water. When the recording medium is determined to be the water-repellent sheet, the water-repellent sheet is compulsively discharged, or set to wait at a position, before an image is transferred, enabling the sheet to be removed, thereby preventing the water-repellent paper with oil on a surface thereof from being returned to a paper path for the second-side recording.

11 Claims, 21 Drawing Sheets

RECORDING APPARATUS AND METHOD FOR HANDLING DIFFERENT TYPES OF RECORDING MEDIUM

BACKGROUND OF THE INVENTION

1. Field of the Invention

The present invention relates to a recording apparatus capable of recording images on both sides of recording paper in an electrophotographic system, and more particularly, to a recording apparatus employing water-repellent recording paper such as an OHP sheet as a recording medium.

2. Description of the Related Art

There is conventionally a case that this kind of recording apparatus uses an OHP sheet as a recording medium on which an image is recorded. In the case where a conventional recording apparatus records an image on the OHP sheet, the apparatus performs specific feeding control because the OHP sheet is different from normal recording paper. That is, a feeding speed for the OHP sheet is made lower than that for the normal recording paper. It is because a thickness of the OHP sheet is greater than that of a sheet of the normal recording paper, so that it is necessary to fix the image with a higher temperature in the OHP sheet than in the normal sheet to improve fixing characteristics when the image is fixed. The feeding speed for the OHP sheet is thus decreased, whereby the fixing temperature for the OHP sheet is relatively increased to improve the fixing characteristics.

However, the aforementioned conventional recording apparatus has following problems when a color image is recorded on the OHP sheet.

That is, in order to prevent deterioration of an image quality, a recording apparatus with a function for recording color images cleans residual toners on a fixing roller, while coating an oil on a surface of the fixing roller to improve residual toner removing characteristics at the time of cleaning. It is because toners with a plurality of colors on the recording paper adhere to the fixing roller at the time of fixing, and leaving the adhering residual toners after the fixing results in that the residual toners adhere to next recording paper as mixed color stains. Thus, the color recording apparatus coats the oil on the fixing roller to improve the residual toner removing characteristics, and thereby prevents the image quality from deteriorating.

Meanwhile, since an OHP sheet is a recording medium made of a water-repellent material that does not absorb an oil, the OHP sheet tends to be discharged with an oil on a surface thereof after the fixing as compared to normal recording paper. Therefore, when images are recorded on both sides of recording paper and the OHP sheet is used as a recording medium, the OHP sheet has an oil on a surface thereof after an image on the first side thereof is fixed, and is returned to a paper path for the second-side recording with the oil thereon, whereby the oil adheres to a surface of a roller on the paper path, which causes the roller to be stained, and which further causes recording paper fed thereafter to slip.

SUMMARY OF THE INVENTION

The present invention is carried out in the view of the foregoing. It is an object of the present invention to provide a recording apparatus with a lo function of both-side recording capable of preventing a roller on a paper path from being stained and paper from slipping even when sheets of recording paper contain a water-repellent recording medium such as an OHP sheet.

In the present invention, when an instruction to perform the both-side recording for recording images on both sides of a recording medium is input, it is determined whether or not the recording medium on which an image is to be recorded is a water-repellent sheet that repels water. When it is determined that the recording medium is the water-repellent sheet, the water-repellent sheet is compulsively discharged, or set to wait at a position, before an image is transferred, enabling the sheet to be removed, thereby preventing the water-repellent paper with an oil on a surface thereof from being returned to a paper path for the second-side recording.

A first aspect of the present invention is a recording apparatus provided with an input section for use in inputting an instruction to perform both-side recording for recording an image on each of both sides of a recording medium, a determining section that determines whether the recording medium is a water-repellent sheet that repels water, and a controller that compulsively discharges the water repellent sheet when the both-side recording is instructed and the determining section determines that the recording medium to be subjected to image recording is the water-repellent sheet.

Thus in the case where the recording medium is determined to be the water-repellent sheet, although the both-side recording is instructed, compulsively discharging the water repellent sheet makes it possible to prevent the water-repellent sheet with an oil on a surface thereof from being fed again to a paper path, whereby the oil on the water-repellent sheet does not adhere to a surface of each roller arranged on the paper path. As a result it is possible to prevent the roller from being stained and to prevent next recording paper from being stained due to the stain of the roller, and further possible to prevent the next recording paper from slipping on the paper path due to the oil adhering to the surface of the roller.

Since usually different images are not recorded on both sides of a water-repellent sheet as a recording medium, the aforementioned aspect is not against a purpose of an operator, and is rather convenience. It is possible to prevent the occurrences of inconveniences in the apparatus due to the operator instructing the both-side recording on the water-repellent sheet incorrectly in the cases such that the operator instructs the both-side recording while misunderstanding that normal recording paper is stored in a paper cassette despite water-repellent sheets being stored therein, and that the water-repellent sheet is accidentally mixed among normal recording paper stored in a paper cassette.

According to a second aspect of the present invention, in the recording apparatus of the first aspect, when the both-side recording is instructed and further the determining section determines that the recording medium to be subjected to the recording is the water-repellent sheet, the controller compulsively discharges the water-repellent sheet after recording the image on one side of the sheet.

Therefore in the case where the recording medium is determined to be the water-repellent sheet, although the both-side recording is instructed, the water-repellent sheet is compulsively discharged after an image is recorded on only one side of the sheet. Hence, even if an operator instructs the both-side recording incorrectly while recognizing that the recording medium is the water-repellent sheet, the operator does not need to instruct the recording again. Therefore it is possible to prevent wasteful consumption of the water-repellent sheet that is not reusable from being caused by discharging the water-repellent sheet with only oil coated thereon without any image recorded thereon.

A third aspect of the present invention is a recording apparatus provided with an input section for use in inputting an instruction to perform both-side recording for recording images on both sides of a recording medium, a feeding mechanism that circulates a plurality of recording media on a paper path to pass through a fixing section in a predetermined order in the case of the both-side recording, a determining section that determines whether the recording medium is a water-repellent sheet that repels water, and a controller that compulsively discharges the water-repellent sheet and all the recording media present on the paper path when the both-side recording is instructed and further the determining section determines that the recording medium to be subjected to the recording is the water-repellent sheet.

Thus in the case of the feeding mechanism that circulates a plurality of recording media on a paper path in the both-side recording, when the recording medium is determined to be the water-repellent sheet, although the both-side recording is instructed, not only the water-repellent sheet but also all the recording media present on the paper path are compulsively discharged, whereby an area on the paper path is once emptied to start the recording operation from the first step, and therefore it is possible to prevent unnecessary recording media from being generated due to the recording order being disordered.

A fourth aspect of the present invention is a recording apparatus provided with an input section for use in inputting an instruction to perform both-side recording for recording images on both sides of a recording medium, a determining section that determines whether the recording medium is a water-repellent sheet that repels water, and a controller that sets the water repellent sheet to wait at a predetermined position before the image is transferred when the both-side recording is instructed and the determining section determines that the recording medium to be subjected to the recording is the water-repellent sheet.

According to a fifth aspect of the present invention, in the recording apparatus of the fourth aspect, the predetermined position where the water-repellent sheet is set to wait is a position corresponding to a cover for paper jam removing.

Therefore in the case where the recording medium is determined to be the water-repellent sheet, although the both-side recording is instructed, the image recording is not performed on the water-repellent sheet, which is set to wait at the predetermined position, before another position where the image is transferred, corresponding to the cover for paper jam removing, whereby it is possible to prevent the water-repellent sheet with an oil on a surface thereof from being fed again to a paper path. It is thereby possible to prevent the oil on the water-repellent sheet from adhering to a surface of each roller arranged on the paper path to stain the roller, and further possible to prevent next recording paper from slipping due to the oil adhering to the surface of the roller. Furthermore, since the water-repellent sheet with the oil only coated thereon without any image recorded thereon is not discharged, it is possible to prevent the water-repellent sheet that is not reusable from being used wastefully.

A sixth aspect of the present invention is a recording apparatus provided with a recording section that superimposes color images on an intermediate transfer material to transfer to a recording medium, an input section for use in inputting an instruction to perform both-side recording for recording images on both sides of the recording medium, a determining section that determines whether the recording medium is a water-repellent sheet that repels water, and a controller that sets the water-repellent sheet to wait at a predetermined position before the image is transferred when the both-side recording is instructed and the determining section determines that the recording medium to be subjected to the recording is the water-repellent sheet, where the color image is still stored on the intermediate transfer material after the water repellent sheet is removed, and the color image is transferred to another recording medium that is next provided.

The color image is thereby stored on the intermediate transfer material even when the water-repellent sheet is used incorrectly as a recording medium, whereby it is possible to transfer the color image to a recording medium fed next without forming again the same color image on the intermediate transfer material. As a result, it is possible to perform the reprinting speedy and efficiently after the water-repellent sheet is removed.

A seventh aspect of the present invention is a recording apparatus provided with a recording section that superimposes color images on an intermediate transfer material to transfer to a recording medium, an input section for use in inputting an instruction to perform both-side recording for recording images on both sides of the recording medium, a feeding mechanism that circulates a plurality of recording media on a paper path to pass through a fixing section in a predetermined order in the case of the both-side recording, a determining section that determines whether the recording medium is a water-repellent sheet that repels water, and a controller that sets the water-repellent sheet to wait at a predetermined position before the image is transferred when the both-side recording is instructed and the determining section determines that the recording medium to be subjected to the recording is the water-repellent sheet, still stores the color image on the intermediate transfer material after the water-repellent sheet is removed, and transfers the color image to another recording medium that is next provided, where the color image stored on the intermediate transfer material is deleted after the other recording media present on the paper path are removed after the water-repellent sheet is removed.

Thus in the case of circulating a plurality of recording media on a paper path in the both-side recording, when the water-repellent sheet is detected on the paper path, although the both-side recording is instructed, the recording operation is once stopped to remove the water-repellent sheet, while the color image stored on the intermediate transfer material is deleted after the other recording media present on the paper path are removed, whereby the color image is formed again on the intermediate transfer material according to the order to restart printing under a condition that not only the water-repellent sheet, but also the recording medium with an image recorded on one-side thereof are removed from the paper path. As a result, it is possible to prevent images for one side and the other side for each page from being recorded on different recording media with the sides inverted and/or the order disordered, and to prevent recording media with unnecessary images recorded thereon from being wastefully consumed.

According to an eighth aspect of the present invention, in the recording apparatus of either of the first to third aspects, the controller continues to store data of the image to be recorded on the recording medium when the controller compulsively discharges recording media including the water-repellent sheet, while deleting data of the image recorded on the recording medium when the controller discharges the recording medium normally.

Thus, the image corresponding to the compulsive discharge is stored in performing the compulsive discharge, while the image corresponding to the normal discharge is deleted after the recording operation is finished in performing the normal discharge. Therefore in the case of performing the compulsive discharge, re-recording is started by setting again an appropriate recording medium and instructing the recording. It is thereby possible to prevent the occurrence of a labor for transferring again the image to be recorded due to the compulsive discharge being performed.

According to a ninth aspect of the present invention, in the recording apparatus of either of the first to eighth aspects, the determining section has a sensor which detects that the recording medium passes through a position on a paper path, and a transmission sensor that detects the recording medium which passes through the position.

The recording media is thereby automatically determined to be the water-repellent sheet without an operator not designating that the recording paper is the water-repellent sheet by manual operation, whereby even in the case where the operator instructs the both-side recording incorrectly despite the water-repellent sheet being set, it is possible to assuredly prevent a roller on the paper path from being stained and paper from slipping.

A tenth aspect of the present invention is a recording method comprising the steps of detecting that an instruction to perform both-side recording for recording images on both sides of a recording medium is input, determining or not whether the recording medium on which an image is to be recorded is a water-repellent sheet that repels water, and compulsively discharging the water-repellent sheet when the instruction for the both-side recording is input and the recording medium to be subjected to the recording is determined to be the water-repellent sheet.

An eleventh aspect of the present invention is a recording method comprising the steps of detecting that an instruction to perform both-side recording for recording images on both sides of a recording medium is input, determining whether or not the recording medium on which an image is to be recorded is a water-repellent sheet that repels water, and setting the water-repellent sheet to wait at a predetermined position before the image is transferred when the instruction for the both-side recording is input and the recording medium to be subjected to the recording is the water-repellent sheet.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENTS

Embodiments of the present invention will be described specifically below with reference to accompanying drawings.

(First Embodiment)

Figure 1:
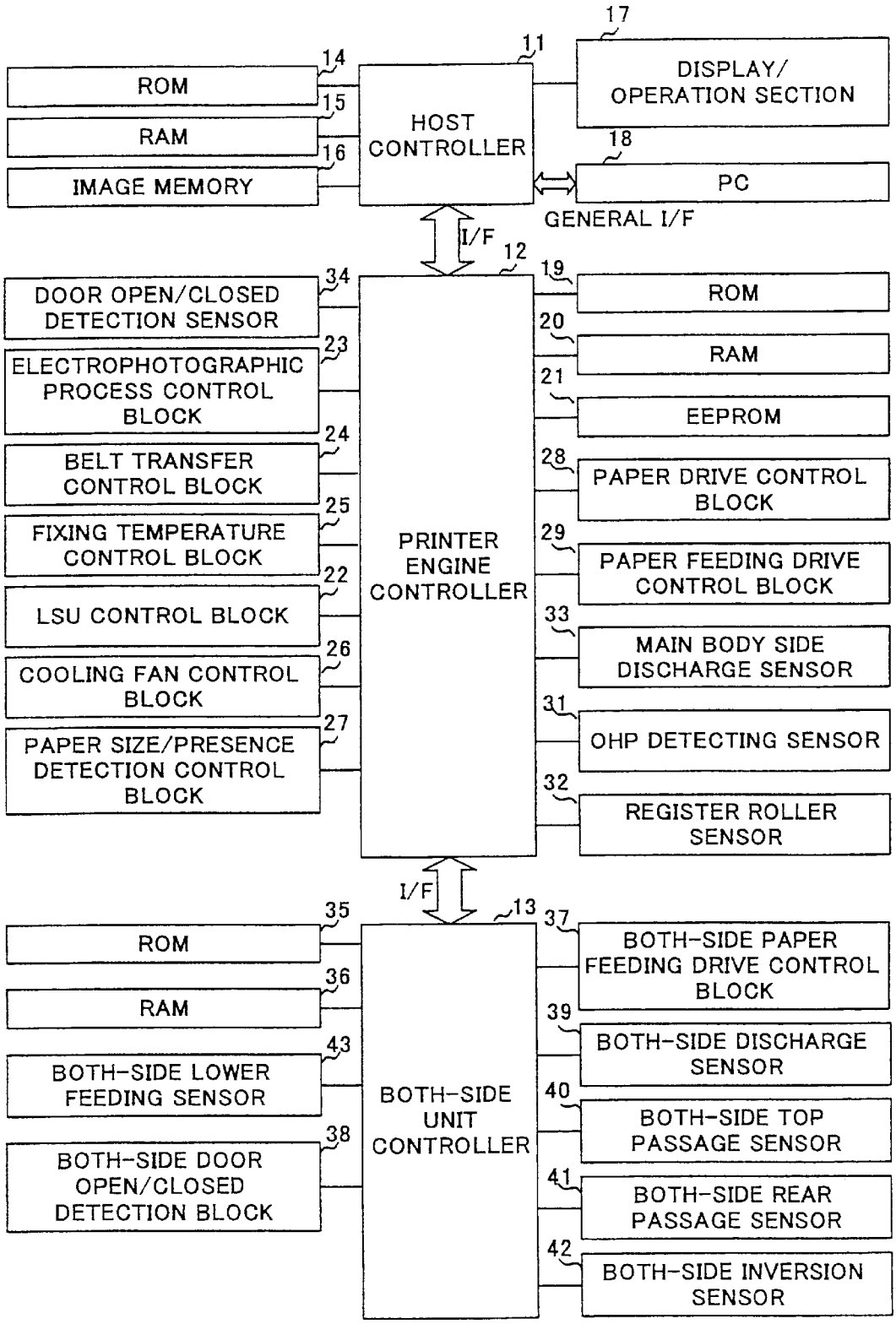
FIG. 1 is a functional block diagram of a color recording apparatus according to first to third embodiments.

FIG. 1 is a functional block diagram of a color recording apparatus provided with an automatic both-side recording function according to this embodiment. The color recording apparatus of this embodiment has three controllers of host controller 11 that controls operations of an entire apparatus, printer engine controller 12 that controls operations of recording sections, and both-side unit controller 13 that controls operations of a both-side unit.

Host controller 11 is connected to ROM 14 storing a program for use by host controller 11 to execute various processing described later, RAM 15 for use by host controller to use as a work area in executing the processing, image memory 16 for use in expanding an image to be printed to bit map images, and display/operation section 17 comprised of an operation section for use by an operator to input an instruction to host controller 11, and a display section that presents information to the operator. Further host controller 11 is connectable to external apparatus 18 such as a personal computer through a general interface. When host controller 11 receives data comprised of page description language and image data from external apparatus 18, the controller 11 analyzes the page description language, expands the image data to bit map data for each page in image memory 16, and sends a printing request to printer engine controller 12.

Printer engine controller 12 is connected to host controller 11 through an interface enabling various data to be transmitted and received. Printer engine controller 12 is connected to ROM 19 storing a program for use by printer engine controller 12 to execute processing described later, RAM 20 for use by printer engine controller 12 to use as a work area in executing the processing, and EEPROM 21 storing data such as counter data of a counter that counts the number of sheets of recording paper and life of a process cartridge.

Printer engine controller 12 is further connected to a plurality of control blocks that control various units that perform recording operations. The plurality of control blocks include LSU control block 22 that forms an electrostatic image on photoconductor 70, electrophotographic process control block 23 that controls electrophotographic processes, belt transfer control block 24 that controls the operation for transferring the image to an intermediate transfer material from photoconductor 70, fixing temperature control block 25 that controls a fixing temperature, cooling fan control block 26 that controls a cooling fan, paper size/presence detection control block 27 that detects a paper size and presence of paper, paper drive control block 28 that controls the operation for feeding recording paper form a paper cassette, and paper feeding drive control block 29 that controls feeding of the recording paper.

Printer engine controller 12 receives detection signals input from a plurality of sensors which detects various conditions required for controlling the recording operation. The plurality of sensors include OHP detection sensor 31 that detects whether a recording paper sheet to record an image is an OHP sheet, register roller sensor 32 that detects that the recording paper reaches a waiting position before the intermediate transfer unit, main body side discharge sensor 33 that detects that the recording paper is discharged from a main body, and door open/closed detection sensor 34 that detects whether each of doors, provided in the main body, for paper jam removing or maintenance is open or closed.

In addition, while this embodiment describes about an OHP sheet as an example of water-repellent recording media with low oil absorption, this embodiment is similarly applicable to other sheets that are water-repellent recording media.

Both-side unit controller 13 is connected to printer engine controller 12 through an interface enabling various data to be transmitted and received. Both-side unit controller 13 is connected to ROM 35 storing a program for use by both-side unit controller 13 to execute processing described later, and RAM 36 for use by both-side unit controller 13 to use as a work area in executing the processing.

Both-side unit controller 13 is further connected to both-side paper feeding drive control block 37 that controls feeding of the recording paper carried along a paper path in a both-side unit, and both-side door open/closed detection block 38 that detects whether or not each of doors is opened to expose a corresponding portion of the paper path in the both-side unit. Moreover both-side unit controller 13 receives sensor signals input from a plurality of sensors provided opposite different portions in the both-side unit. The plurality of sensors include both-side discharge sensor 39 that detects that the recording paper is discharged outside the apparatus from the both-side unit, both-side top passage sensor 40 that detects that the recording paper is passed through a top unit of the both-side unit, both-side rear passage sensor 41 that detects that the recording paper is passed through a rear unit of the both-side unit, both-side inversion sensor 42 that detects that the recording paper reaches an inversion section of the both-side unit, and both-side lower feeding sensor 43 that detects that inverted recording paper reaches a position to wait before being fed to the paper path in the main body.

Figure 2:
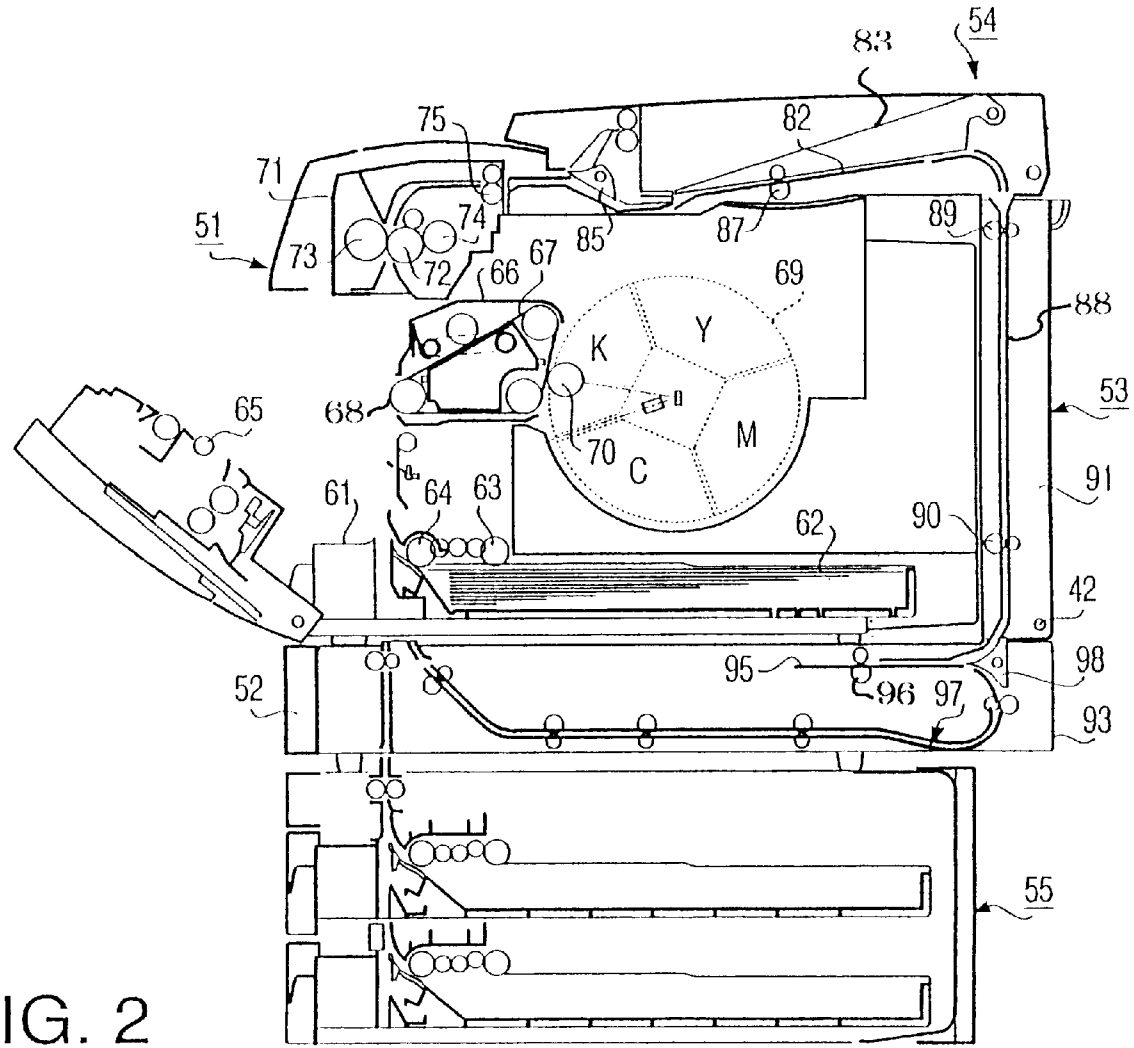
FIG. 2 is a structural view showing a mechanism of the color recording apparatus according to the first to third embodiments.

FIG. 2 is a structure view of mechanical sections in the color recording apparatus of this embodiment. FIG. 2 illustrates the apparatus with a front door of the main body unit opened. This color recording apparatus is comprised of main body unit 51 composing a main body of the apparatus, inversion unit 52 attached to a bottom of main body unit 51, rear unit 53 attached to a rear of main body unit 51, top unit 54 attached to a top of main body unit 51, and two paper cassettes 55 further provided under a lower surface of inversion unit 52.

Main body unit 51 executes feeding, transfer, recording and fixing processing. Paper cassette 61 is provided on a bottom of main body unit 51 in such a manner as to enable itself to be drawn toward a front side of main body unit 51. A top sheet of the recording paper of recording paper bunch 62 is picked up from paper cassette 61 by pick-up roller 63. The recording paper picked up from paper cassette 61 is provided to register roller 65 with feeding roller 64. Transfer unit 66 is located forward of register roll 65 in paper feeding direction. Transfer unit 66 has transfer film 67 on which four images with different colors are superimposed. Process unit 69 is located adjacent transfer unit 66. Process unit 69 is provided with four process cartridges with respective colors. An image with a corresponding color is formed on photoconductor 70 provided in each cartridge. Four images with different colors formed using the four process cartridges for respective colors are superimposed on the same position on transfer film 67. Transfer unit 66 transfers the image formed on transfer film 67 to the recording paper with transfer roller 68. At this point, register roller 65 controls an adjustment of positions of transfer film 67 and a top end of the recording paper. The recording paper with the image transferred thereto is provided from transfer unit 66 to fixing unit 71. Fixing unit 71 is provided with fixing roller 72, pressurizing roller 73 arranged opposite to fixing roller 72, and cleaning roller 74 that coats an oil on fixing roller 72 to enable toners remaining on fixing roller 72 to be removed easily. Fixing roller 72 applies a heat to a recording surface of the recording paper, and pressurizing roller 73 presses the recording paper against fixing roller 72, whereby an image is fixed on the recording paper. Discharge roller 75 is provided at an outlet of fixing unit 71. Opening cover 86 frontward from main body unit 51 completely exposes a paper path in paper feeding direction from a portion before register roller 65 to a portion before fixing unit 71, and thereby enables paper jam to be removed.

An automatic both-side unit is formed of inversion unit 52, rear unit 53, and top unit 54 respectively located under the bottom, on the outer rear, and on the top of main body unit 51. The automatic both-side unit inverts recording paper with an image recorded on one side thereof to record another image on a reverse side thereof, and conveys the recording paper to an inlet of a paper path of main body unit 51.

Paper path 82 is formed inside top unit 54. Top unit 54 has cover 83 to expose an upper side of paper path 82. The upper surface of cover 83 is used as a discharge paper tray when the automatic both-side unit is installed. An inlet of top unit 54 is in the vicinity of a discharge opening of main body unit 51. Switching pawl 85, provided at the inlet of top unit 54, delivers recording paper discharged from the discharge opening of main body unit 51 to a discharge paper tray side or a paper path 82 side (automatic both-side unit side). The recording paper delivered to the discharge paper tray side is discharged to the discharge paper tray (upper surface of cover 83) with discharge roller 86. The recording paper delivered to the paper path 82 side is fed to a rear unit 53 side with feed roller 87.

Rear unit 53 is attached to the rear of main body unit 51. Paper path 88, connected to paper path 82 in top unit 54, is formed inside rear unit 53. A pair of feed rollers 89 and another pair of feed rollers 90 are provided respectively at upper and lower portions along paper path 88. The recording paper passed through paper path 88 in rear unit 53 is led to inversion unit 52.

Inversion unit 52 is provided with drawer frame 93 with the same shape as that of the bottom of main body unit 51 and with no front surface, and drawer 94 stored in drawer frame 93. Draw-in path 95, to which the recording paper that is not inverted is drawn in, is formed to connect to paper path 88 in rear unit 53. Forward-reverse roller 96 is located on draw-in path 95. Forward-reverse roller 96 draws the recording paper fed from rear unit 53 into draw-in path 95, while sending out the recording paper once drawn into draw-in path 95 in the reverse direction. In other words, the recording paper, drawn into drawn-in path 95 with a top end thereof, is drawn out with a rear end thereof. Further inversion path 97 is formed that turns over the recording paper drawn out with the rear end thereof by 180 degrees to invert an upside and downside of the paper. Guide 98 is provided at a branch point of draw-in path 95 and inversion path 97. Guide 98 guides the recording paper fed from rear unit 53 to be drawn into draw-in path 95, while guiding the recording paper drawn out from draw-in path 95 to inversion path 97. An outlet of the paper path formed inside inversion unit 52 (draw-in path 95 and inversion path 97) is connected to an inlet of the one-side path in main body unit 51.

Figure 3:
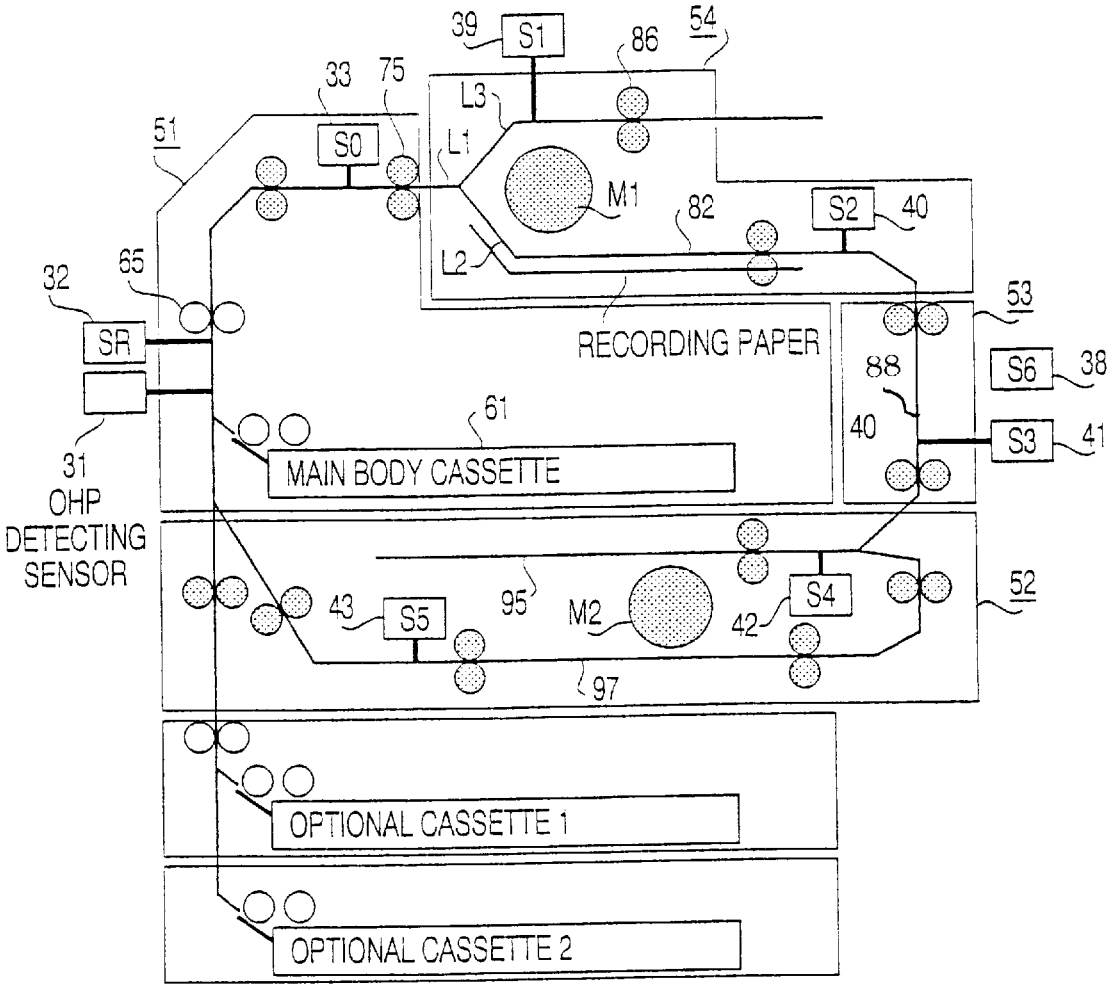
FIG. 3 is a side view showing paper paths and sensor positions in the color recording apparatus according to the first to third embodiments.

FIG. 3 is a diagram illustrating paper paths and sensor positions in the color recording apparatus of this embodiment. The paper paths and sensor possessions are explained below in feeding direction. Register roller sensor 32 is located at a position opposite register roller 65 before transfer unit 66, and OHP detecting sensor 31 is located before register roller sensor 32. Main body side discharge sensor 33 is located in the vicinity of main body side discharge outlet. Both-side discharge sensor 39 is located at a side of paper path L3 in top unit 54. Both-side top passage sensor 40 is located at a position forwardly on paper path L2 in top unit 54. Both-side rear passage sensor 41 is located in rear unit 53. Both-side inversion sensor 42 is located at drawn-in path 95 in inversion unit 52, and both-side lower feeding sensor 43 is located at inversion path 97.

Figure 4:
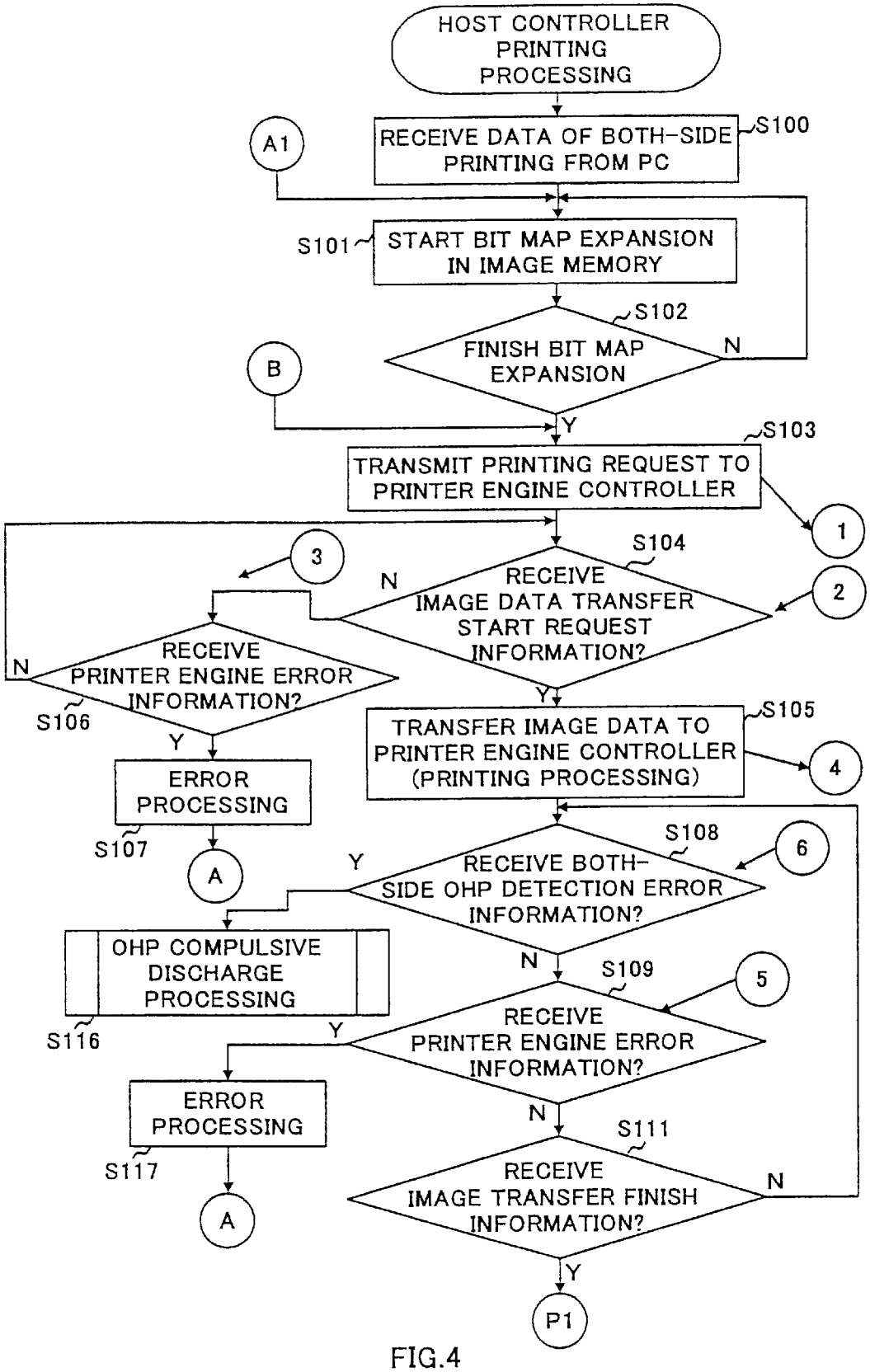
FIG. 4 is a flow diagram of first half of printing processing in a host controller in the first embodiment.
Figure 5:
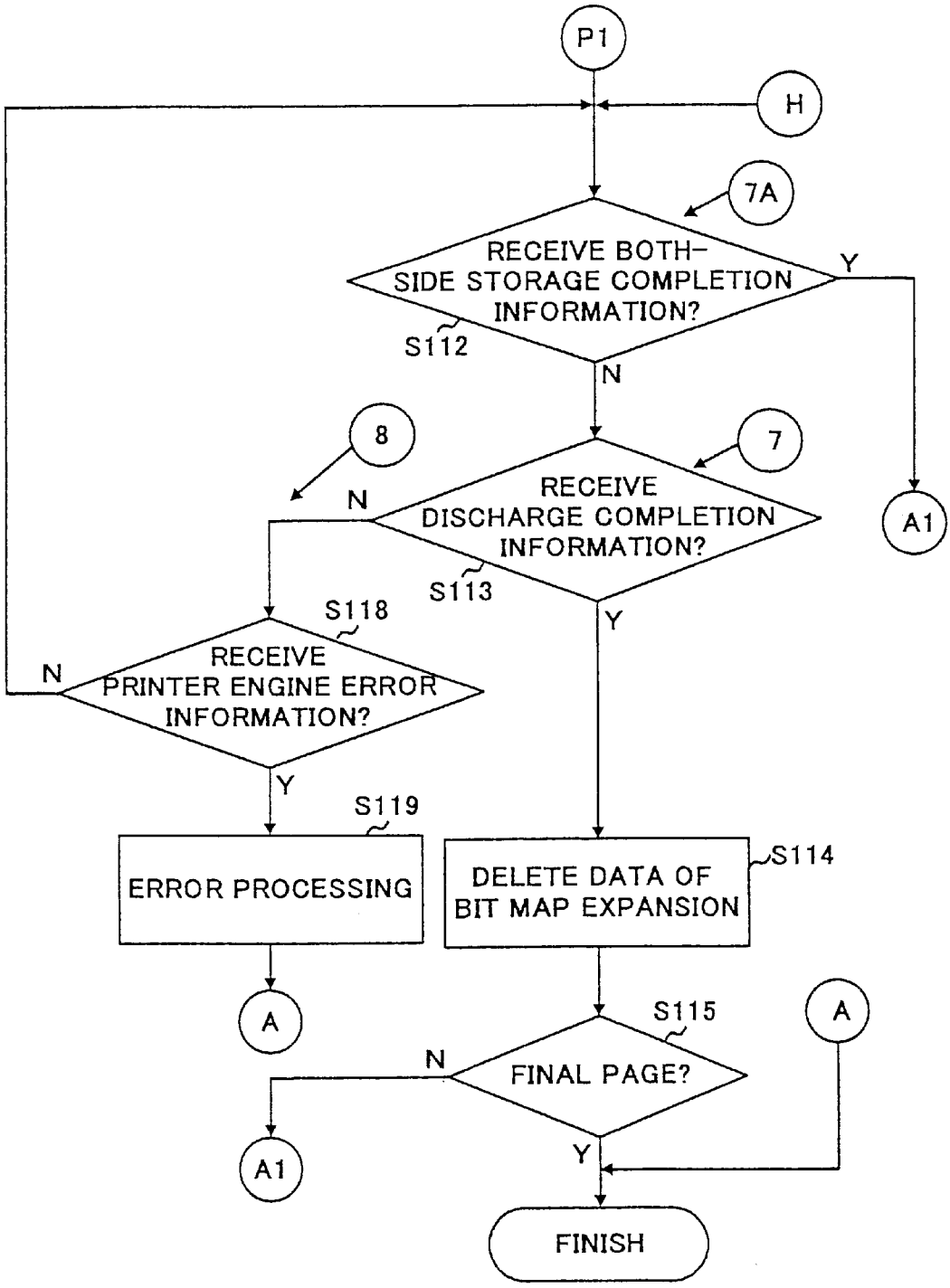
FIG. 5 is a flow diagram of latter half of the printing processing in the host controller in the first embodiment.
Figure 6:
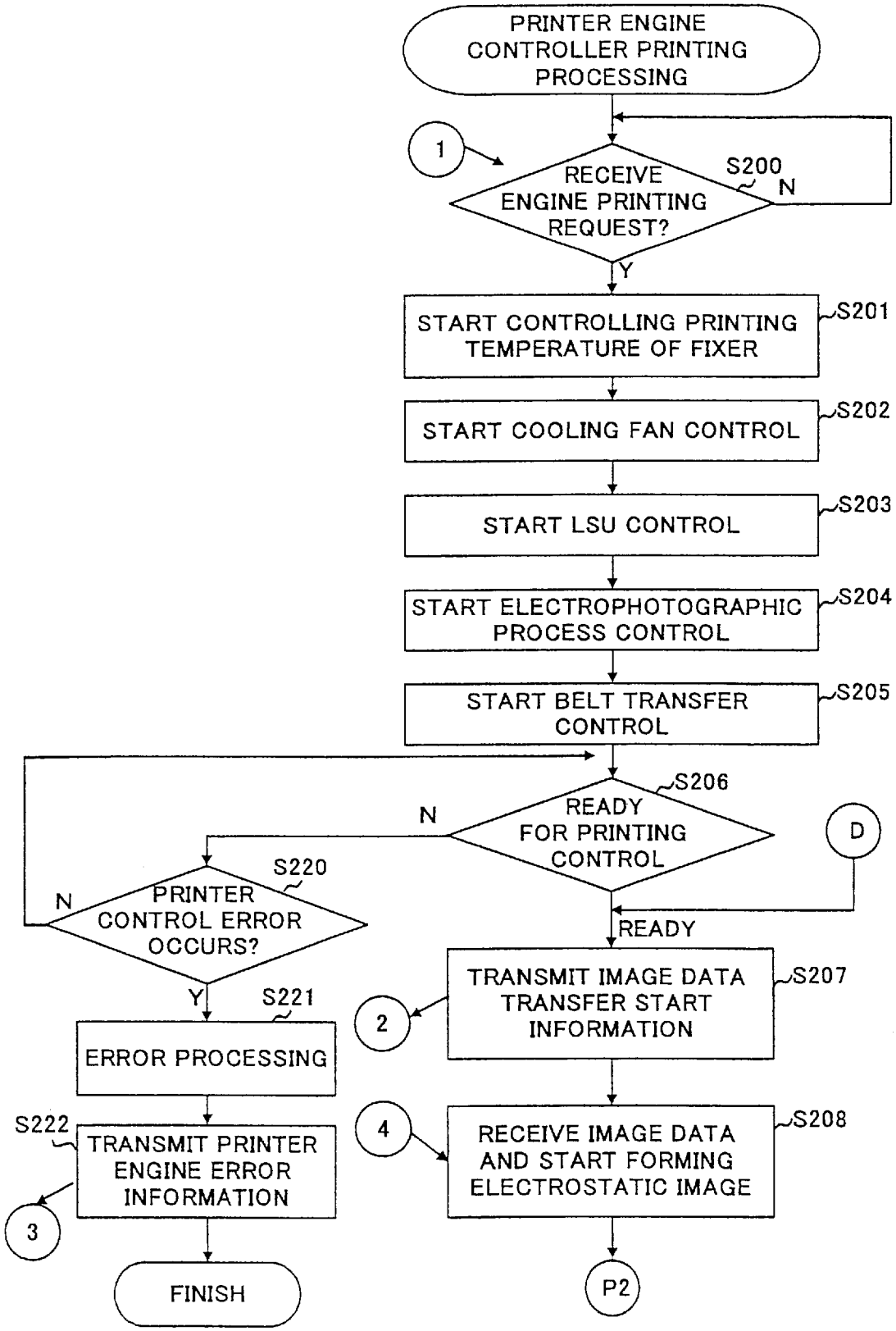
FIG. 6 is a flow diagram of first part of printing processing in a printer engine controller in the first embodiment.
Figure 7:
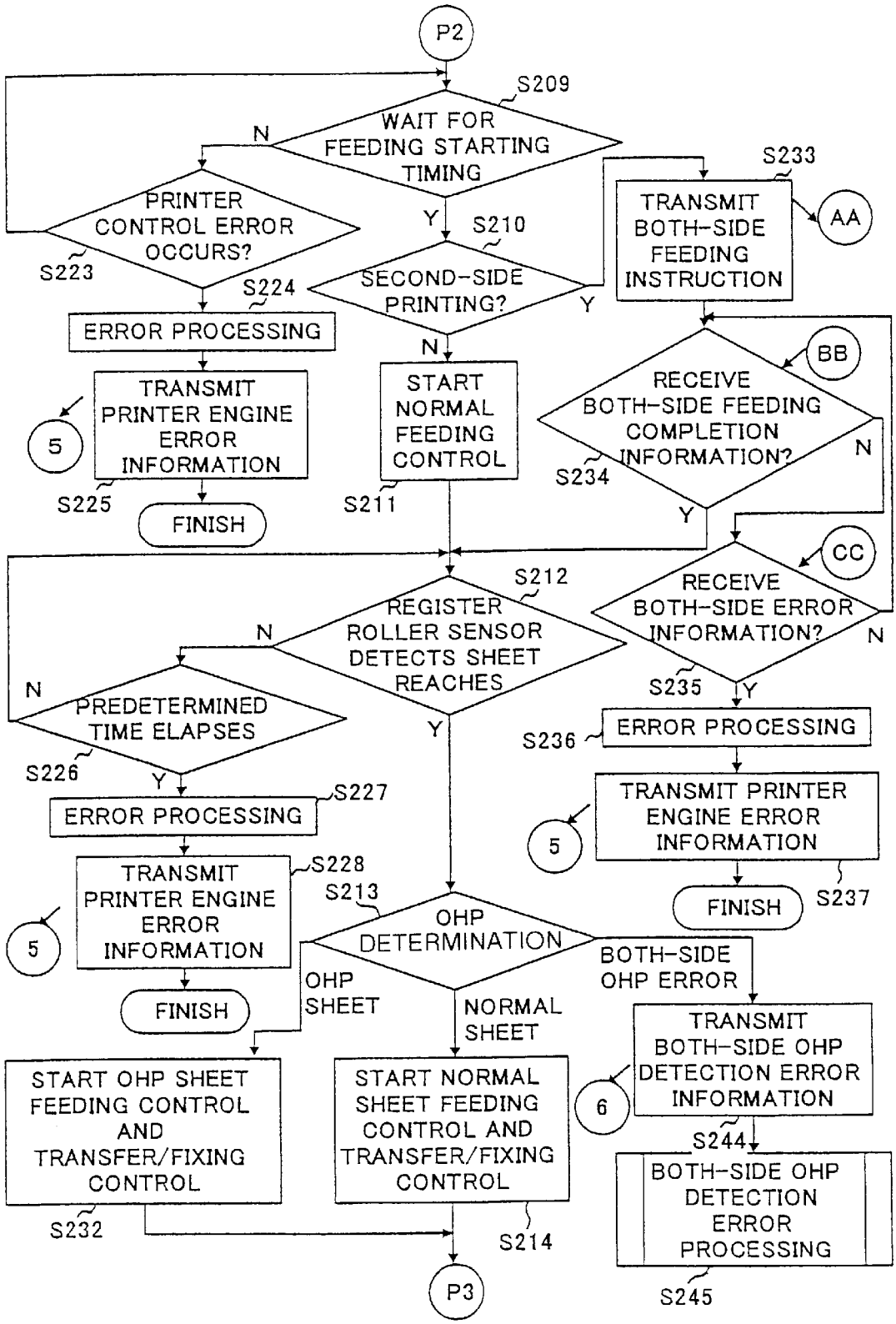
FIG. 7 is a flow diagram of intermediate part of the printing processing in the printer engine controller in the first embodiment.
Figure 8:
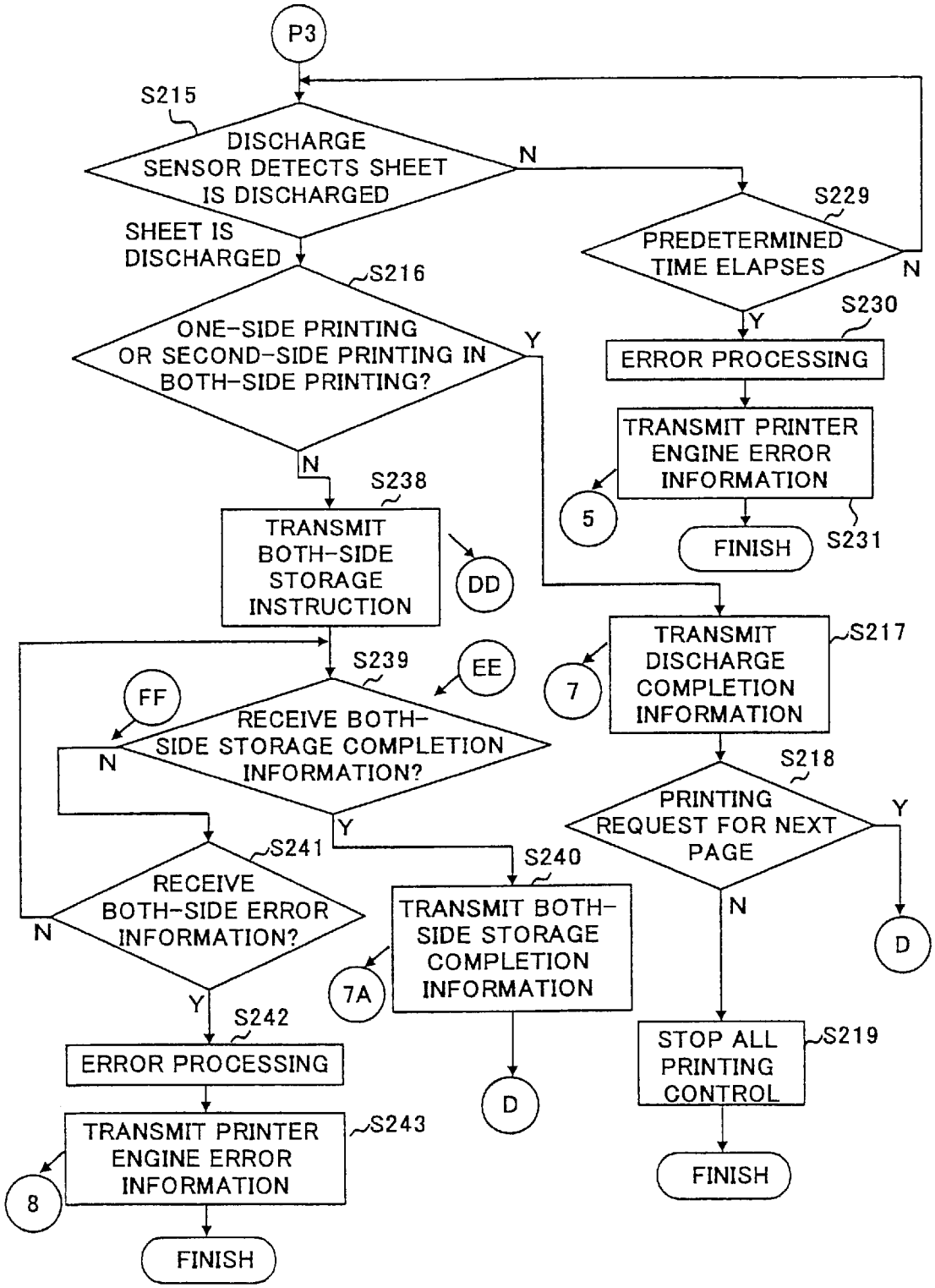
FIG. 8 is a flow diagram of last part of the printing processing in the printer engine controller in the first embodiment.
Figure 9:
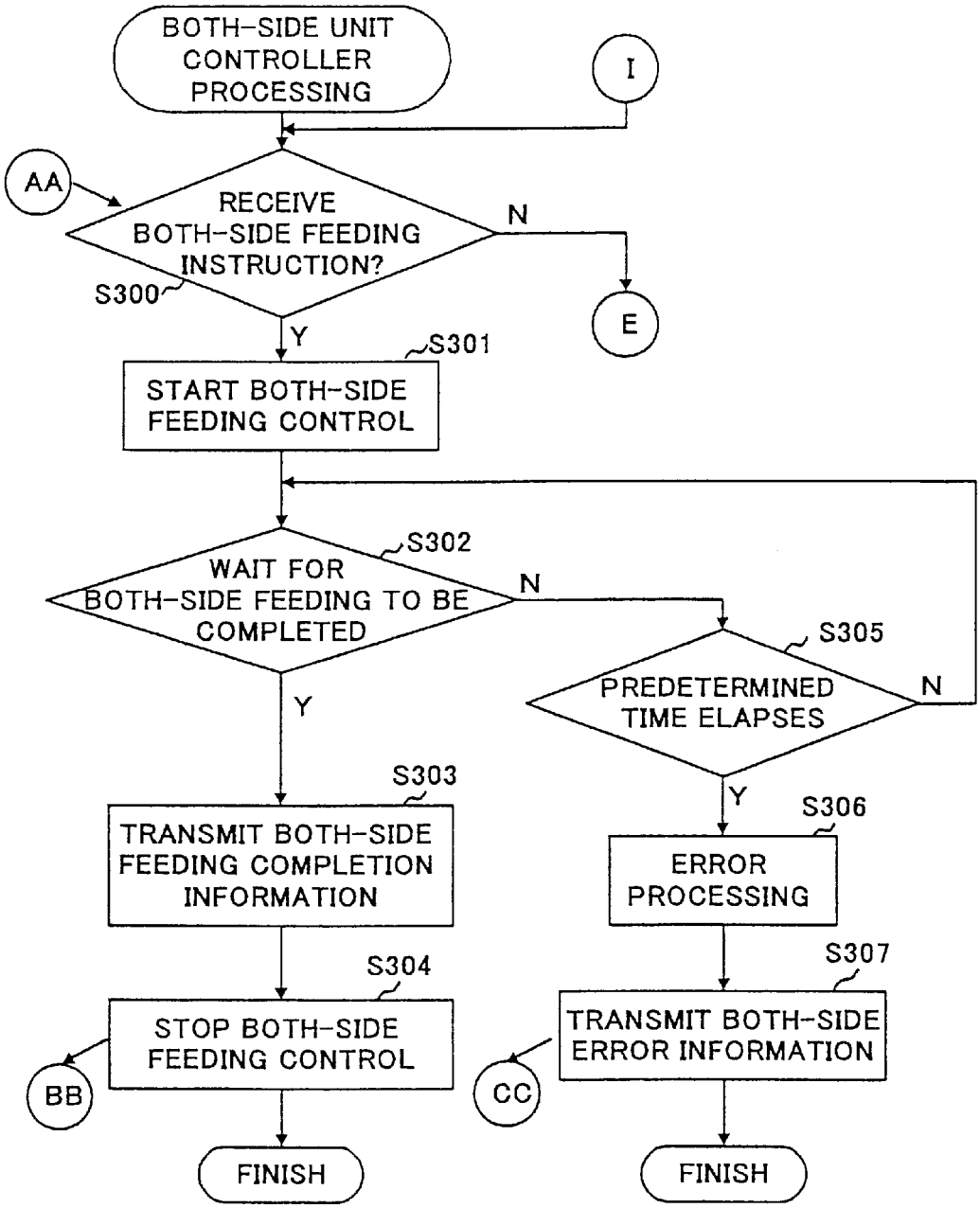
FIG. 9 is a flow diagram of both-side feeding processing in a both-side unit controller in the first embodiment.
Figure 10:
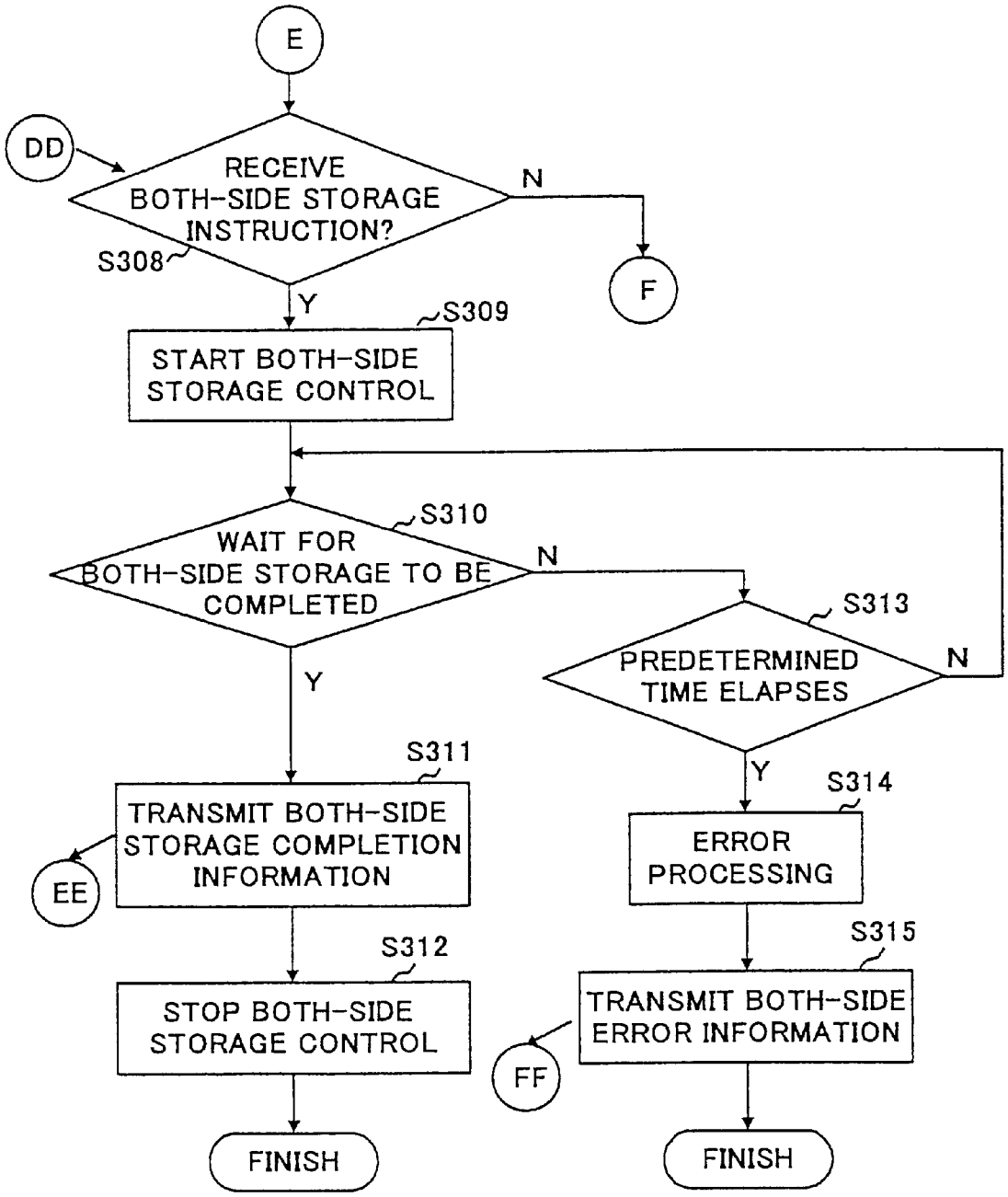
FIG. 10 is a flow diagram of both-side storage processing in the both-side unit controller in the first embodiment.

The operation of the color recording apparatus configured as described above is explained specifically with reference to flowcharts. FIGS. 4 and 5 are flowcharts of printing processing in host controller 11, FIGS. 6 to 8 are flowcharts of printing processing in printer engine controller 12, and FIGS. 9 and 10 are flowcharts of printing processing in both-side unit controller 13.

First explained is operation contents in the case where a recording medium is a normal recording sheet and one-side printing is instructed. In this case, the one-side printing instruction is contained in printing data transmitted from external apparatus 18 to host controller 11, and is input to host controller 11.

Host controller 11 receives the printing data (page description language and image data) from external apparatus 18 (S100), and expands the image data per page to bit map data to store in image memory 16 (S101). After the bit map expansion corresponding to one page is finished (S102), host controller 11 transmits a printing request to printer engine controller 12 (S103).

When printer engine controller 12 receives the printing request from host controller 11 (S200), the controller 12 starts control of sections required for the recording operation in main body unit 51 (S201 to S205). After completing a preparation for the recording operation (S206), the controller 12 transmits information to request for starting image data transfer to host controller 11 (S207).

Host controller 11 waits at step S104 for receiving the image data transfer start request information from printer engine controller 12. When the controller 11 does not receive the image data transfer start request information, the controller 11 judges whether or not printer engine error information is received (S106). When the printer engine error information is received, the controller 11 executes error processing (S107) to finish the processing.

When host controller 11 receives the image data transfer start request information, it starts transferring the image data expanded in image memory 16 to printer engine controller 12 (S105). After starting the image data transfer, the controller 11 judges whether or not both-side OHP detection error information is received (S108). When the both-side OHP detection error information is received, the controller 11 executes OHP compulsive discharge processing described later (S116). When the both-side OHP detection error information is not received, the controller 11 further judges whether or not the printer engine error information is received (Sl09). When the printer engine error information is received, the controller 11 executes predetermined error processing (S117) to complete the processing.

When error information (both-side OHP detection error or printer engine error) is not received (S108 and S109), the controller 11 judges whether or not transfer of image data corresponding to one page is finished (S111). When the transfer of image data corresponding to one page is finished, the controller 11 judges whether or not both-side storage completion information is received from printer engine controller 12 (S112). In this case, since the one-side printing is instructed, a processing flow is branched to step S113, and the controller 11 judges whether discharge completion information is received.

Meanwhile, printer engine controller 12 receives the image data transferred from host controller 11 (S208) after requesting to transfer the image data at step S207. Printer engine controller 12 instructs LSU control block 22 so that an electrostatic image of received image data is formed on photoconductor 70, and further controls electrophotographic process control block 23 so that toners are adhered to the electrostatic image formed on photoconductor 70. Then the controller 12 instructs belt transfer control block 24 so that each color image is transferred to the same positions on a transfer belt from photoconductor 70 (S208).

Printer engine controller 12 waits for an preparation for the image recording to be done prior to starting feeding paper (S209). Using a timing at which the color image is intermediate-transferred to the transfer belt as a reference, the controller 12 generates a paper feeding starting timing. When it comes to the paper feeding staring timing, the controller 12 judges whether or not the printing is for a second side (S210). In this case, since there is instructed the one-side printing, and therefore the printing is for a first side, a processing flow is branched to step S211 to start normal feeding control (S211). The controller 12 instructs feeding drive control block 28 and paper feeding drive control block 29 so that recording paper is picked up from paper cassette 55, and fed to a paper path in main body unit 51. When the recording paper reaches a position before register roller 65 in feeding direction, register roller sensor 32 detects the recording paper (S212).

After register roller sensor 32 detects the recording paper, printer engine controller 12 judges whether or not the recording paper to be subjected to the recording is an OHP sheet from a detection signal of OHP detecting sensor 31 arranged in feeding direction before and adjacent to register roller sensor 32 (S213). A transmission sensor is used as OHP detecting sensor 31. The controller 12 checks the detection signal of OHP detecting sensor 31 when a top end of the recording paper reaches immediately before register roller 65 in feeding direction. When the recording paper is the OHP sheet through which a light is transmitted, a probe light is transmitted through the OHP sheet, and therefore a detected light intensity exceeds a predetermined value. When the recording paper is normal paper, the transmittance of the probe light is largely decreased, and therefore the detected light intensity does not exceed the predetermined value. Accordingly the recording paper is determined to be the OHP sheet when the detected light intensity exceeds the predetermined value.

In this case, since the recording paper is the normal paper, and therefore the detected light intensity does not exceed the predetermined value, the recording paper is determined to be the normal paper. In the case of the normal recording paper, the printer engine controller 12 starts recording paper feeding control and transfer/fixing control suitable for the normal recording paper (S214).

The recording paper with the image recorded thereon is discharged from main body side discharge roller 75 to a side of top unit 54. When main body side discharge sensor 33 located in feeding direction before main body side discharge roller 75 detects a passage of the recording paper (S215), the controller 12 checks whether or not the printing is one-side printing or second-side printing (S216). Since it is the one-side printing in this case, a processing flow is branched to step S217, and the controller 12 transmits,the discharge completion information to host controller 11 (S217). Then the controller 12 judges whether or not there is another page (S218), and when there is no more page, the controller 12 stops the printing control (S219).

When host controller 11 receives the discharge completion information that printer engine controller 12 transmits in the processing of step S217 described above (S113), the controller 11 deletes the corresponding bit map data expanded in image memory 16 (S114). Thus the controller 11 deletes the bit map data expanded in image memory 16 after confirming that the recording paper with the image recorded thereon is discharged, whereby it is possible to transfer image data from image memory 16 immediately after a paper jam or recording error occurs, enabling a quick response.

Host controller 11 checks whether or not there is another page after deleting the bit map data in image memory 16 (S115), and finishes the processing after deleting the bit map data of a final page. Further when the controller 11 receives the printer engine error information from printer engine controller 12 during an interval of waiting for receiving the discharge completion information at step S113 (S118), the controller 11 performs the error processing (S119) and finishes the processing.

In addition, when printer engine controller 12 detects a printing control error at the step of executing the preparation operation for the image recording after receiving the printing request (S220), the controller 12 executes the error processing (S221), and transmits the printer engine error information indicative of an error occurring in printer engine controller 12 to host controller (S222). Further when the printing control error occurs during the time the printer engine controller 12 waits for the paper feeding starting timing (S223), the controller 12 executes the error processing (S224), and transmits the printer engine error information to host controller 11 (S225). Furthermore, when register roller sensor 32 does not detect the recording paper after a predetermined time elapses after the paper feeding starting timing is generated (S226), printer engine controller 12 executes the error processing (S227), and transmits the printer engine error information to host controller 11 (S228). In addition, printer engine controller 12 waits for main body side discharge sensor 33 to detect the recording paper at the step S215 after starting the transfer/fixing control, and when the recording paper is not detected after a predetermined time elapses (S229), the controller 12 executes the error processing because there is a possibility that, for example, a paper jam occurs in the main body paper path (S230), and transmits the printer engine error information to host controller 11 (S231).

Thus in the case where the one-side printing is instructed using normal recording paper, there is a possibility that the printer engine error information is transmitted at the step of S222, S225, S228 or S231.

The foregoing is a flow of a series of processing executed in host controller 11 and printer engine controller 12 when a recording medium is normal recording paper and one-side printing is instructed. When the recording medium is an OHP sheet and the one-side printing is instructed, printer engine controller 12 determines that recording paper is the OHP sheet in the processing of step S213, and shifts its processing flow to step S232. At the step S232, the controller 12 performs feeding speed control and transfer/fixing control of the OHP sheet, while switching parameters to those suitable for the OHP sheet. When an image is recorded on the OHP sheet, the processing after the recording is performed according to the processing at steps S215 to S219 in the same way as in the one-side printing on the normal recording paper, and then the OHP sheet is discharged outside the apparatus.

Thus, when a recording medium is an OHP sheet and the one-side printing is instructed, the recording is performed in the same way as in the normal recording paper. It is because an OHP sheet with an image recorded on one side thereof is not circulated in the both-side unit, and therefore inconveniences do not occur such that a roller provided in the both-side unit is stained and/or recording paper slips.

There is, however, a possibility of being stained in a path from the fixing unit to discharge roller 57 in main body unit 51 and a path from paper path L3 to the discharge outlet in top unit 54. The control to prevent these paths from being stained will be described later.

The operation when both-side printing is instructed is next explained. When printing data containing an instruction for the both-side printing is input to host controller 11 from external apparatus 18, host controller 11 transmits the instruction for the both-side printing to printer engine controller 12.

Printer engine controller 12 executes the same processing as in the case of an instruction for the one-side printing according to steps S200 to S209. When the controller 12 determines in the processing of step S210 that the printing is a first-side printing in the both-side recording, the controller 12 shifts its processing flow to step S211 to execute normal control of paper feeding. When it is detected that the recording paper reaches register roller sensor 32 (S212), the controller 12 determines whether or not the recording paper is an OHP sheet (S213). In this OHP determination, when the recording paper to be subjected to recording is determined to be the OHP sheet, the controller 12 transmits both-side OHP detection error information to host controller 11, and then both-side OHP detection error processing described later is executed (S245).

When printer engine controller 12 determines that the recording paper is a normal sheet in the processing of step S213, the controller 12 performs control of feeding, transfer and fixing for normal paper at step S214. Then, when main body side discharge sensor 33 detects the recording paper with a fixed image at step S215, the controller 12 determines whether or not the printing is the one-side printing or second-side printing of both-side printing at step S216.

Herein, it is assumed that the both-side printing instruction is input and that recording is performed on the first side of the recording paper, it is necessary to introduce the recording paper to a side of paper path L2 of top unit 54 to provide to paper path 82 of both-side unit after the paper is discharged from main body unit 51. Then at step S238, the controller 12 transmits a both-side storage instruction to both-side unit controller 13 to instruct that the recording paper discharged from main body unit 51 is stored in a side of the both-side unit (S238).

Figure 14:
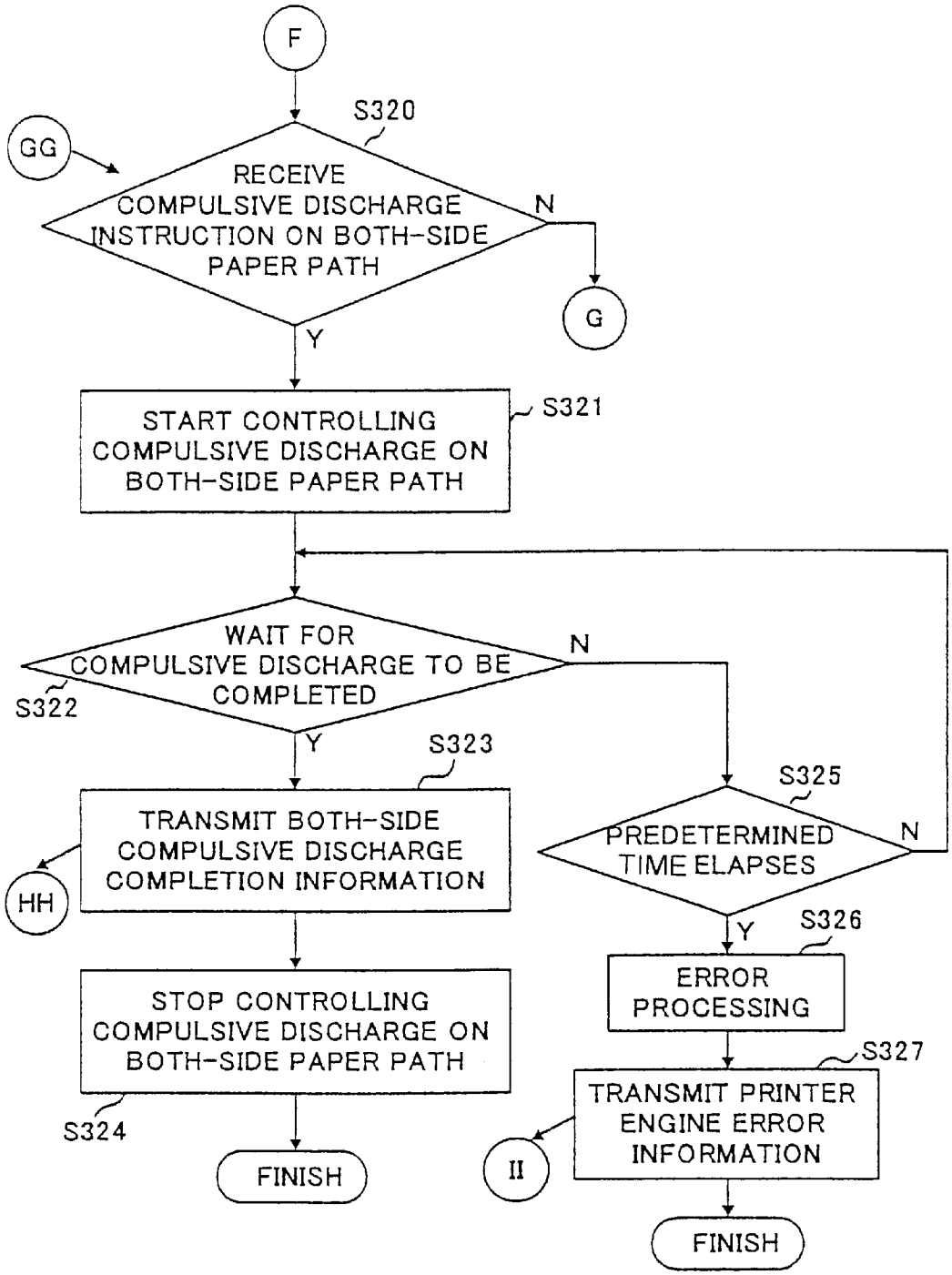
FIG. 14 is a flow diagram of compulsive discharge control processing in the both-side unit controller in the first embodiment.

At this point, both-side unit controller 13 receives from printer engine controller 12 either of a both-side feeding instruction ordering to return recording paper waiting in the both-side unit to a path of the main body, the both-side storage instruction ordering to feed recording paper discharged from the main body to a stand-by position in the both-side unit, and a compulsive discharge instruction ordering to discharge recording paper waiting on a paper path in the both-side unit, and thereby executes the processing in either of FIGS. 9, 10 and 14.

Herein, both-side unit controller 13 is assumed to receive the both-side storage instruction from printer engine controller 12 (S308), and then starts both-side storage control (S309). That is, the controller 13 introduces the recording paper entering paper path L1 in top unit 54 after being discharged from main body unit 51 to the side of paper path L2, and controls the paper so that the paper is passed through top unit 54 and rear unit 53, and then provided to inversion unit 52. Further the controller 13 uses drawn-in path 95 in inversion unit 52 to invert the recording paper, and stores the inverted paper in inversion path 97 in inversion unit 52.

Sensor 43 provided on inversion path 97 in inversion unit 52 detects that inverted recording paper is stored. When the storage of the inverted recording paper is detected (S310), the controller 13 transmits the both-side storage completion information to printer engine controller 12 (S311), and stops the both-side storage control (S312).

In addition, when the storage of inverted recording paper is not detected after a predetermined time elapses after the both-side storage control is started (S313), there is a possibility that a paper jam occurs on a paper path in the both-side unit, and therefore the controller 13 executes error processing (S314), and transmits both-side error information to printer engine controller 12 (S315).

Printer engine controller 12 waits for the both-side storage completion information to be returned in response to the both-side storage instruction transmitted to both-side unit controller 13 at the step S238 (S239). When printer engine controller 12 receives the both-side storage completion information (S239), it transmits the both-side storage completion information to host controller 11 (S240), and shifts its processing flow to step S207 to request host controller 11 to transfer next image data.

In addition, when printer engine controller 12 receives both-side error information without receiving the both-side storage completion information (S241), it performs the error processing (S242), and transmits the printer engine error information to host controller 11 (S243).

When host controller 11 receives the both-side storage completion information from printer engine controller 12 (S112), the controller 11 shifts its processing flow to step S101 to expand another image to bit map image in image memory 16.

Meanwhile, when the image of which the image formation is started at the step S208 is an image to be recorded on a second side, printer engine controller 12 shifts its processing flow from the step S210 to step S233. The controller 12 transmits a both-side feeding instruction to both-side unit controller 13 at the step S233.

In addition, when the both-side recording instruction is input from host controller 11 and an image is to be recorded on a first side, recording paper is picked up from paper cassette 55 in main body unit 51 of which the operation is controlled by printer engine controller 12, and therefore the controller 12 does not transmit the both-side feeding instruction to both-side unit controller 13. The controller 12 transmits the both-side feeding instruction to both-side unit controller 12 only when the feeding control is required in the both-side unit. Specifically, such information is transmitted only in the case of introducing recording paper with an image recorded on the first side thereof waiting in inversion unit 52 to a paper path in main body unit 51 to record another image on the second side of the paper.

When both-side unit controller 13 receives the both-side feeding instruction from printer engine controller 12 (S300), the controller 13 starts controlling feeding of the inverted recording paper waiting in inversion unit 52 (S301). The controller 13 waits for the inverted recording paper in inversion unit 52 to be provided to a paper path in main body unit 51 (S302), confirms that the recording paper is provided to the paper path in main body unit 51, and then transmits both-side feeding completion information to printer engine controller 12 (S303). After transmitting the both-side feeding completion information, the controller 13 stops the both-side feeding control in which recording paper is provided to main body unit 51 with a second side as a recording side (S304). In addition, when the both-side feeding completion is not confirmed after a predetermined time elapses after the both-side feeding control starts at the step S301 (S305), the controller 13 executes the error processing (S306), and transmits the both-side error information to printer engine controller 12 (S307).

When printer engine controller 12 receives the both-side feeding completion information from both-side unit controller 13 in response to the both-side feeding instruction transmitted in the processing of step S233 (S234), the controller 12 shifts its processing flow to step S211 to detect that recording paper for second-side printing fed from inversion unit 52 reaches register roller 65 (S212). When it is confirmed that the recording paper for the second-side printing reaches register roller 65 from a detection signal of register roller sensor 32, the controller 12 confirms that the recording paper is not an OHP sheet (S213).

In addition, as described above, when the both-side recording instruction is input and recording paper is an OHP sheet, the both-side OHP detection error processing is performed at the time of first-side recording. Therefore, when the processing flow is shifted from the step S210 to the step S213 via steps S233 and S234, normal recording paper is certainly detected. Accordingly it may be possible to pass the processing of step S213 in the case of second-side printing.

The recording paper with the image recorded on the second side thereof is discharged outside the apparatus by discharge roller 86, and the controller 12 transmits discharge completion information (S217), and determines whether there is another page to be printed (S218).

Figure 11:
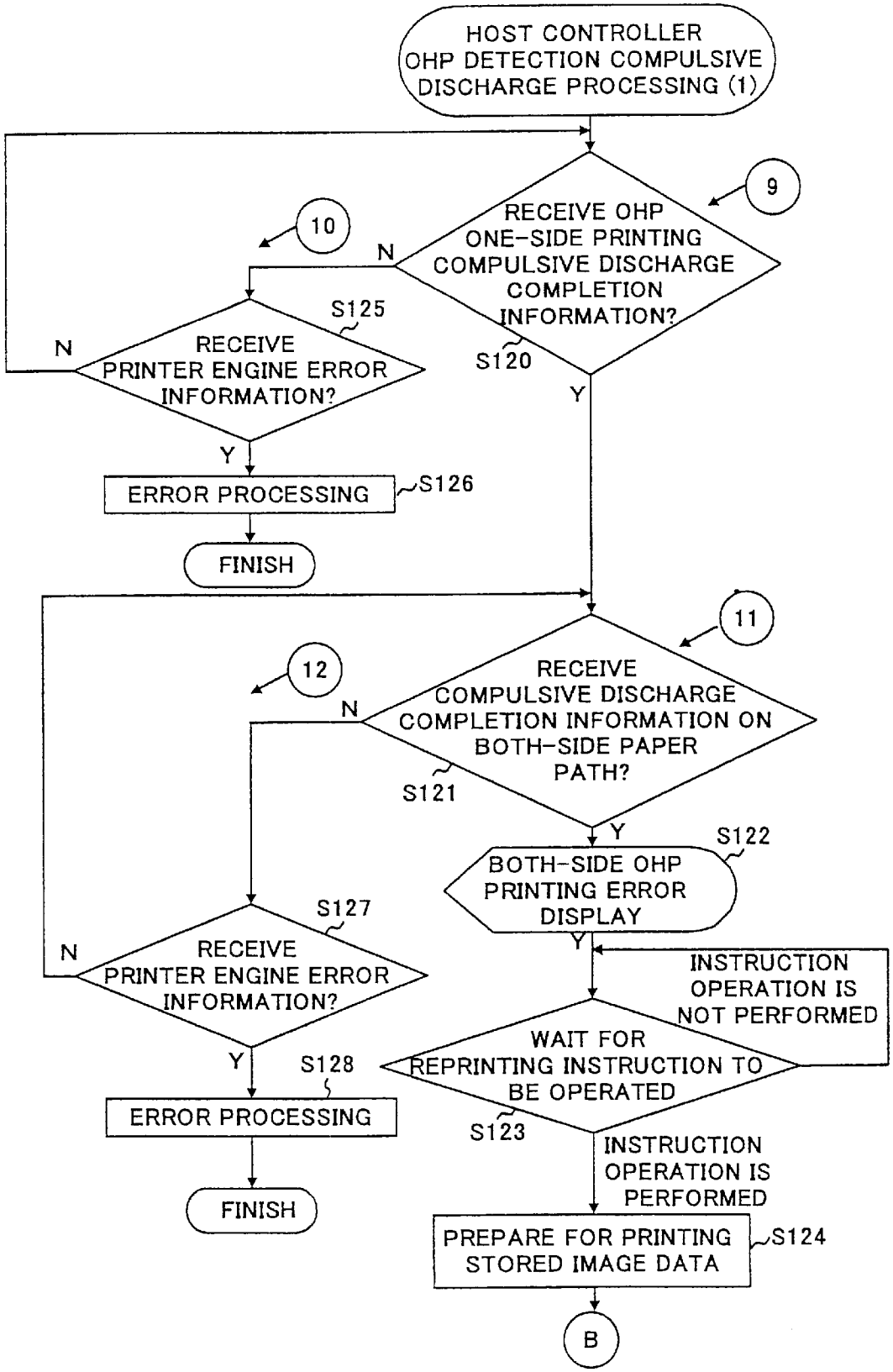
FIG. 11 is a flow diagram of OHP detection compulsive discharge processing in the host controller in the first embodiment.
Figure 12:
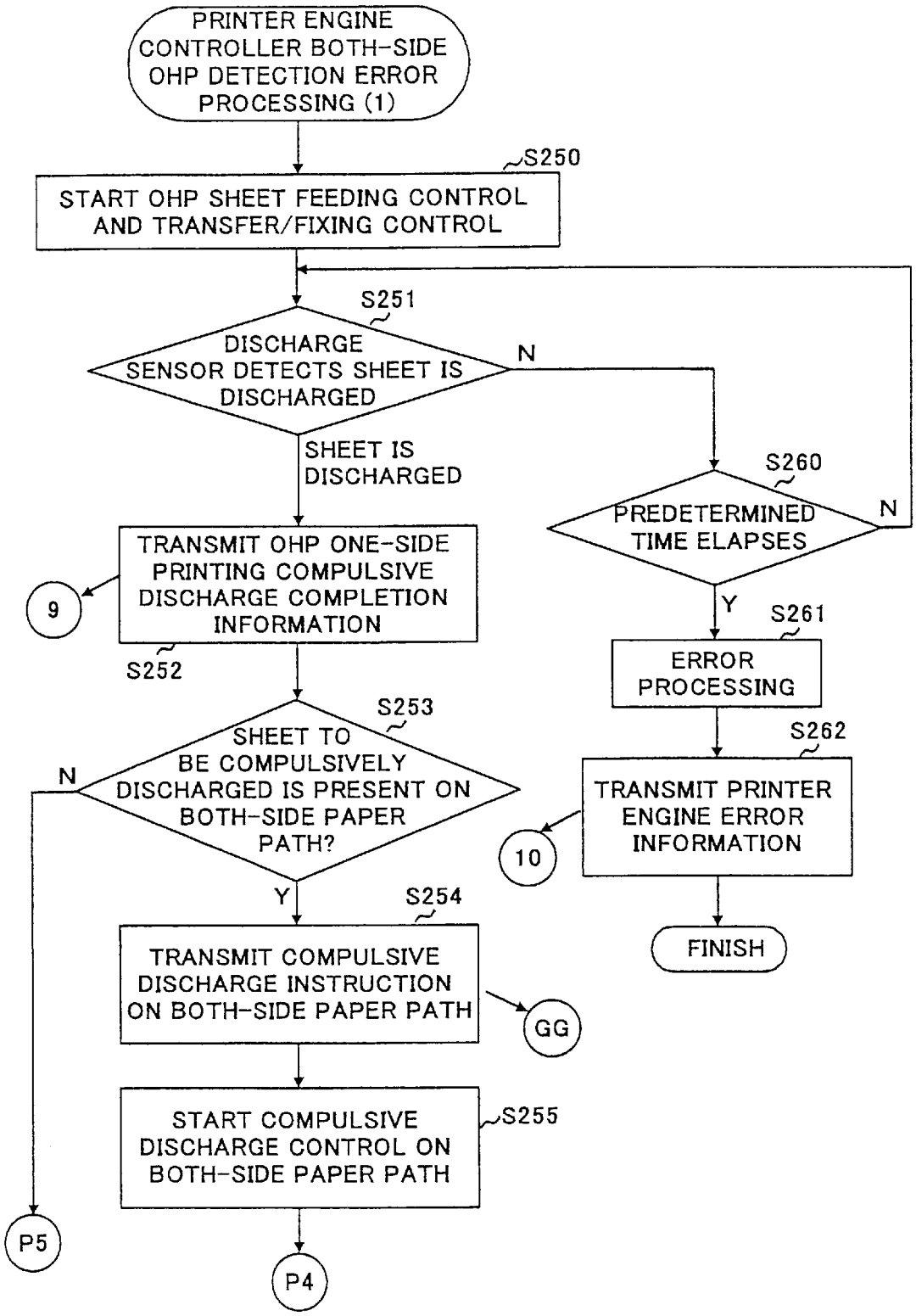
FIG. 12 is a flow diagram of first half of both-side OHP detection error processing in the printer engine controller in the first embodiment.
Figure 13:
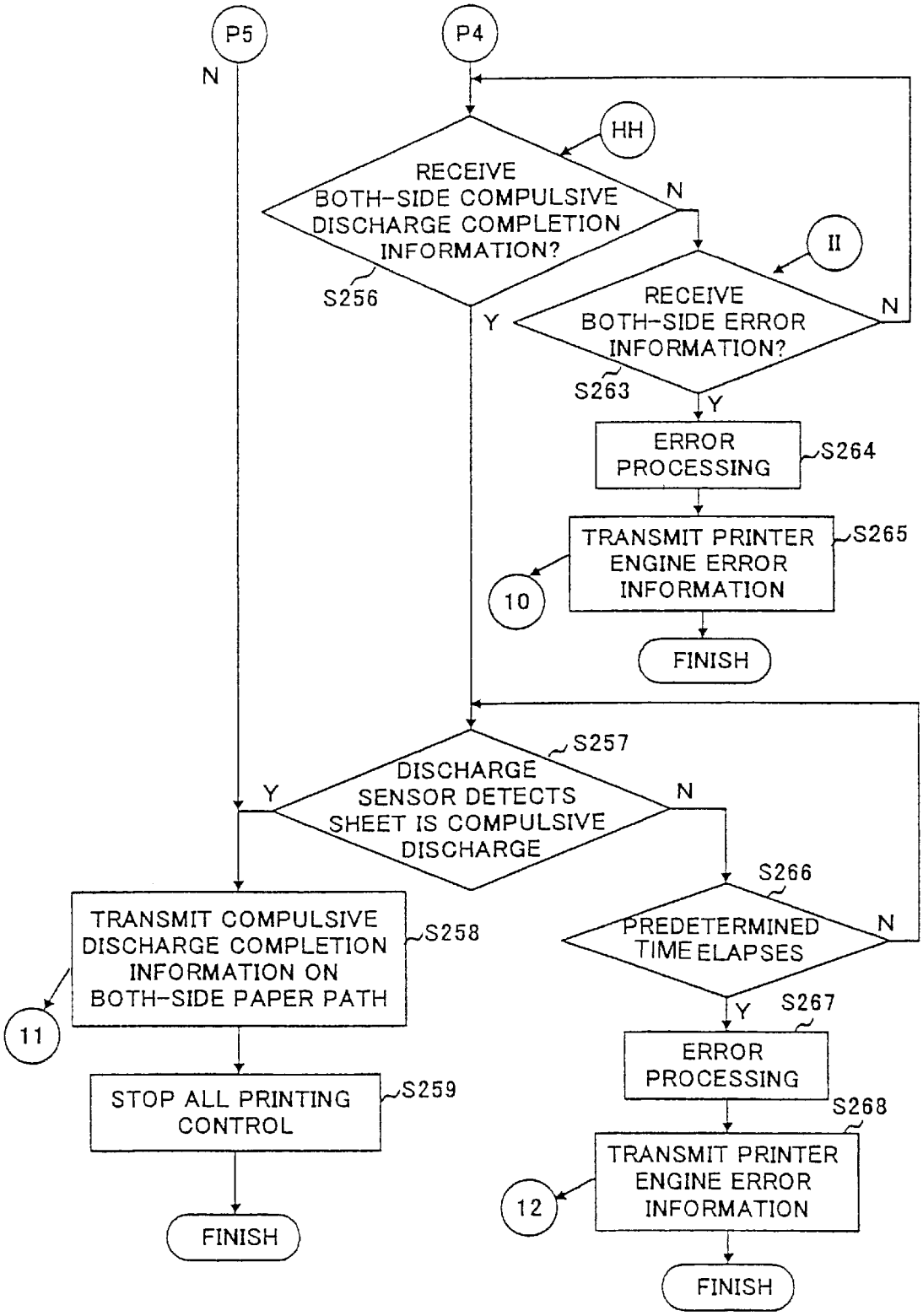
FIG. 13 is a flow diagram of latter half of the both-side OHP detection error processing in the printer engine controller in the first embodiment.

The following explains specifically about the control operation when an OHP sheet is detected with the both-side recording instruction input. FIG. 11 is a flowchart of OHP detection compulsive discharge processing in host controller 11, FIGS. 12 and 13 are flowcharts of both-side OHP detection error processing in printer engine controller 12, and FIG. 14 is a flowchart in both-side unit controller 13 when a both-side OHP detection error is detected.

As described above, when printer engine controller 12 detects that recording paper is an OHP sheet in the processing of step S213 with the both-side recording instructed, the controller 12 performs the both-side OHP detection error processing (S245).

In the both-side OHP detection error processing, an image is recorded on and fixed to a first side of the OHP sheet picked up from paper cassette 55 (S250). At this point, the controller 12 controls a feeding speed and transfer/fixing operation of the OHP sheet with parameters suitable for the OHP sheet. When main body side discharge sensor 33 detects the OHP sheet with the image recorded on the first side thereof (S251), the controller 12 compulsively discharges the OHP sheet outside the apparatus.

Thus, since the OHP sheet is compulsively discharged outside the apparatus, it is possible to prevent an OHP sheet with an oil on a surface thereof from entering again paper path 82 in top unit 54. Therefore the oil on the surface of the OHP sheet does not adhere to a surface of each roller arranged on the paper path of the both-side unit, and consequently it is possible to prevent the roller from being stained and to prevent next recording paper from being stained due to the stain of the roller, and further possible to prevent the next recording paper from slipping on the paper path due to the oil adhering to the surface of the roller.

Moreover, since the OHP sheet is compulsively discharged after an image is recorded on one side thereof, an operator does not need to perform the recording instruction again even if the operator instructs the both-side recording incorrectly while recognizing a recording medium is the OHP sheet. Therefore it is possible to prevent an OHP sheet that is not reusable from being consumed wastefully due to the discharge of OHP sheet without any image recorded thereon only with oil coated thereon.

When the OHP sheet is compulsively discharged with only one-side recording performed thereon as described above, printer engine controller 12 transmits OHP one-side printing compulsive discharge completion information to host controller 11 (S252). In addition, when the OHP sheet is not compulsively discharged after a predetermined time elapses after one-side printing control of the OHP sheet is started at the step S251 (S260), the controller 12 performs the error processing (S261), and transmits the printer engine error information to host controller 11.

Further, printer engine controller 12 judges whether or not recording paper is present on the paper path in the both-side unit (S253). When an OHP sheet is mixed in paper cassette 55, and the OHP sheet is picked up as a target for recording after a few sheets of recording paper in the both-side printing, recording paper subjected to the first-side recording (normal recording paper) waits in inversion path 97 in inversion unit 52. Compulsively discharging the OHP sheet with one-side printing performed thereon disorders a recording order thereafter, and therefore it is necessary to empty the paper path once, and restart the recording operation from the first step. Accordingly printer engine controller 12 judges whether or not such remaining recording paper is present on the paper path.

When printer engine controller 12 judges that recording paper is present on the paper path in the both-side unit in the processing of step S252, it transmits an instruction for compulsively discharging the recording paper in the both-side unit to both-side unit controller 13 (S254). Then inversion unit 52, which undergoes the compulsive discharge control by both-side unit controller 13, starts the compulsive discharge control for discharging the recording paper discharged to the paper path in main body unit 51 outside the apparatus without recording an image (S255).

Meanwhile, when both-side unit controller 13 receives the compulsive discharge instruction from printer engine controller 12 (S320), the controller 13 controls motors M1 and M2 to start the compulsive discharge control for compulsively discharging recording paper present inside the both-side unit to the paper path in main body unit 51 (S321). When all the sensors provided on the paper path in the both-side unit confirm that all recording paper is discharged (S322), the controller 13 transmits both-side compulsive discharge completion information to printer engine controller 12 (S323), and stops the compulsive discharge control of recording paper present on the paper path in the both-side unit (S324).

In addition, when the discharge of recording paper is not completed after a predetermined time elapses after the compulsive discharge control is started in the processing of step S321 (S325), since there is a possibility that a paper jam occurs on the way, the controller 13 executes the error processing in such a case, and transmits the both-side error information to printer engine controller 12 (S327).

When printer engine controller 12 receives the both-side compulsive discharge completion information form both-side unit controller 13 in response to the compulsive discharge instruction transmitted in the processing of step S254 (S256), the controller 12 confirms, using main body side discharge sensor 33, that the recording paper provided to main body unit 51 from the both-side unit is discharged outside the apparatus from main body unit 51 due to the compulsive discharge control by printer engine controller 12 (S257). After confirming the aforementioned condition, the controller 12 transmits the compulsive discharge completion information to host controller 11 (S258), and stops all the printing operations (S259).

In addition, when printer engine controller 12 receives the both-side error information from both-side unit controller 13 during the time of waiting for the both-side compulsive discharge information in the processing of S256 (S263), the controller 12 performs the error processing (S264), and transmits the printer engine error information to host controller 11 (S265). Further, when a time more than or equal to a predetermined time elapses until the recording paper is discharged outside the apparatus main body in the processing of step S257 (S266), the controller 12 performs the error processing due to a possibility that a paper jam occurs on the way (S267), and transmits the printer engine error information to host controller 11 (S268).

Host controller 11 receives the both-side OHP detection error information from printer engine controller 12 (S108), and executes OHP compulsive discharge processing (S109).

Host controller 11 starts the OHP compulsive discharge processing, and waits for the OHP one-side printing compulsive discharge completion information to be sent from printer engine controller 12 (S120). The controller 11 receives the printer engine error information in the case where an error occurs during the both-side OHP detection error processing in printer engine controller 12 (S125), and in such a case, performs the error processing (S126) to finish the processing.

Meanwhile, when host controller 11 receives the OHP one-side printing compulsive discharge completion information from printer engine controller 12 (S120), the controller 11 further waits for the compulsive discharge completion information to be sent from printer engine controller 12 (S121). The controller 11 receives the printer engine error information in the case where an error occurs during the compulsive discharge processing in printer engine controller 12 (S127), and in such a case, performs the error processing (S128) to finish the processing.

When the controller 11 receives the compulsive discharge completion information from printer engine controller 12, the controller 11 displays a both-side OHP printing error on display/operation section 17 (S122). The both-side OHP printing error display contains a request for reprinting operation. With this error display, an operator is capable of confirming that the recording operation is stopped due to the OHP sheet mixed among recording paper for both-side printing.

When the operator inputs a reprinting instruction from display/operation section 17 in response to the both-side OHP printing error display (S123), host controller 11 starts a preparation for printing stored image data (S124). When the both-side recording instruction is input as described above, the both-side storage completion information (7A) is transmitted to host controller 11 when recording paper subjected to first-side recording is stored in the both-side unit. Host controller 11 that receives the information shifts its processing flow to step S101 and starts bit map expansion of next image data without performing processing of a step (S114) for deleting image data for the first side expanded in image memory 16. In other words, the image data recorded on the first side of the recording paper stored in the both-side unit (then compulsively discharged) is stored in image memory 16 without being deleted. The image data is stored in image memory 16 until it is confirmed that the recording paper is discharged outside the apparatus with the first side and second side thereof undergoing normal recording. Accordingly at step S124, the controller 11 determines a recording order with respect to image data stored in image memory 16 to start recording from a first one of unrecorded images (including the image recorded on the first side of the recording paper compulsively discharged).

Thus in the recording apparatus provided with the both-side unit, a plurality of sheets of recording paper are circulated on the paper paths in the case of both-side recording. However when a recording medium is determined to be an OHP sheet, although the both-side recording is instructed, not only the OHP sheet but also all recording paper present on the paper paths is compulsively discharged to empty the paper paths, and then the recording operation is restarted from the fist step, thereby making it possible to prevent an unnecessary recording medium from being generated due to a disordered recording order.

Further, an image corresponding to the compulsive discharge is stored in image memory 16 when the recording medium is compulsive discharged, while an image corresponding to the normal discharge is deleted from image memory 16 after the corresponding recording operation is finished when the recording medium is normally discharged. Therefore in the case where the compulsive discharge is performed, since re-recording is started only by setting again an appropriate recording medium and instructing the recording, it is possible to prevent the occurrence of a labor such that the image to record should be transferred again due to the compulsive discharge being performed.

In addition, while in the first embodiment, when the both-side OHP detection error occurs, an OHP sheet is discharged with an image recorded on one side thereof, it may be possible to control to compulsively discharge the OHP sheet without performing recording thereon.

(Second Embodiment)

A color recording apparatus according to this embodiment has the same constitution as that of the color recording apparatus in the first embodiment with the expectation that it performs different control contents at the time an OHP both-side detection error occurs. The same reference numerals as those in the first embodiment are used for the same components and processing steps as those in the first embodiment.

In this embodiment, when the OHP both-side detection error occurs, an image on an intermediate transfer material is stored, an OHP sheet is removed before the transfer unit after waiting, and the image stored on the intermediate transfer material is used at the time of reprinting.

Figure 15:
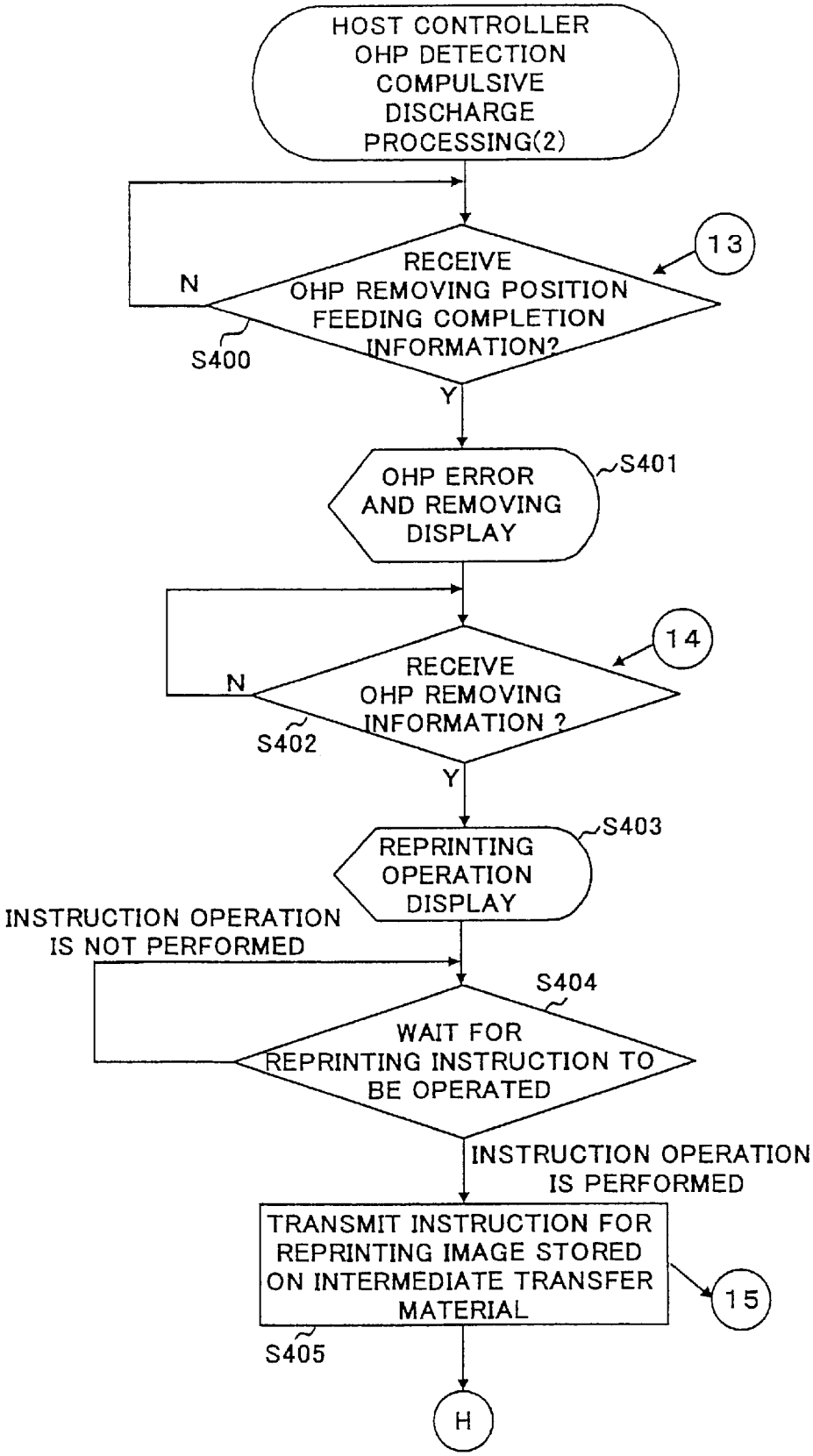
FIG. 15 is a flow diagram of OHP detection compulsive discharge processing in a host controller in a second embodiment.
Figure 16:
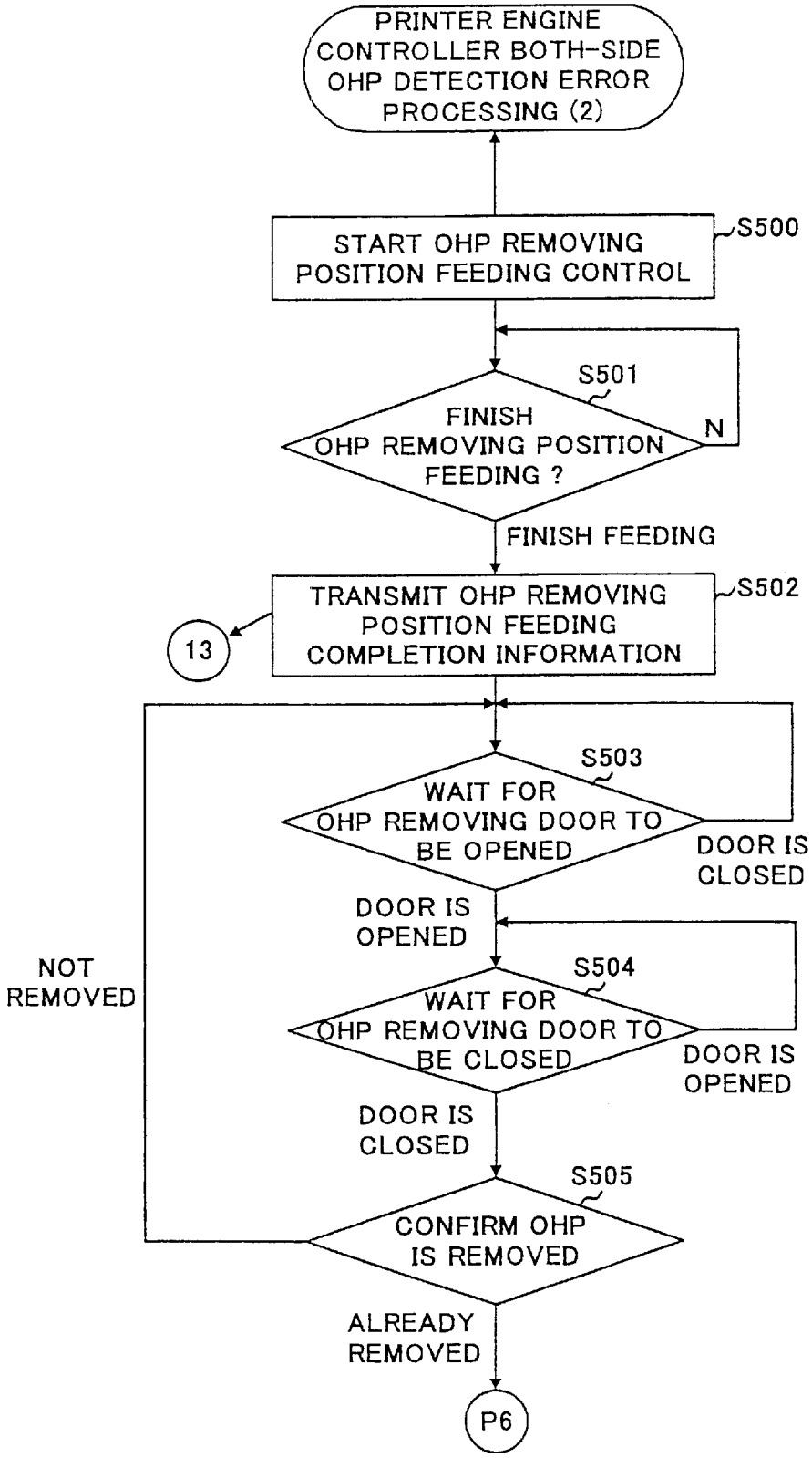
FIG. 16 is a flow diagram of first half of both-side OHP detection error processing in a printer engine controller in the second embodiment.
Figure 17:
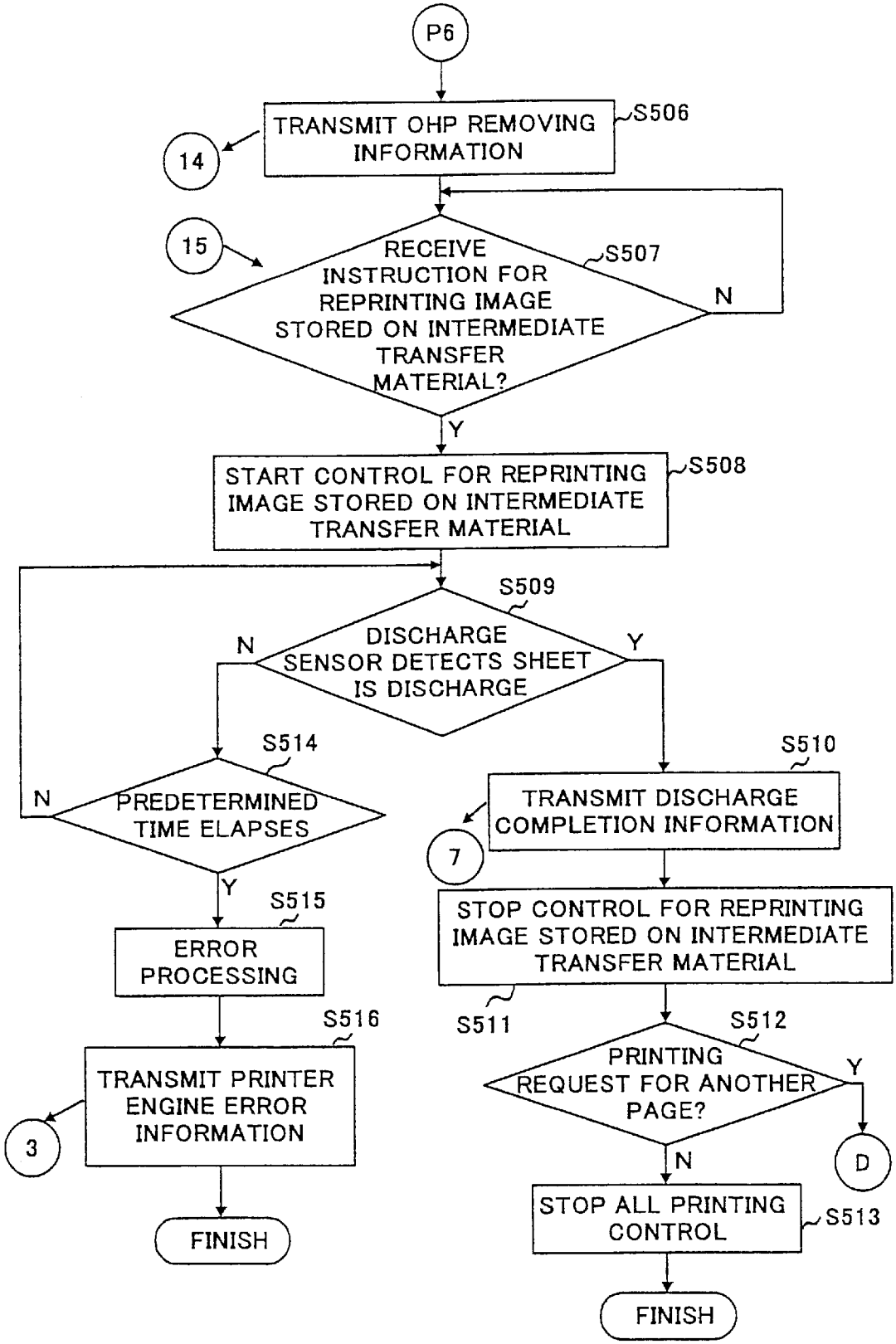
FIG. 17 is a flow diagram of latter half of the both-side OHP detection error processing in the printer engine controller in the second embodiment.

FIG. 15 is a flowchart of OHP detection compulsive discharge processing performed by host controller 11, and FIGS. 16 and 17 are flowcharts of both-side OHP detection error processing performed by printer engine controller 12.

When printer engine controller 12 detects that recording paper is an OHP sheet at the time the both-side recording is instructed in the processing of step S213 as described above, t he controller 12 performs the both-side OHP detection error processing (S245).

In the both-side OHP detection error processing of this embodiment, the OHP sheet of which a top end reaches a position of register roller sensor 32 is carried to a position corresponding to a cover for removing a paper jam before the intermediate transfer unit in which an image is transferred (S500 and S501). Cover 86 provided on a front wall of the apparatus main body is opened and closed so as to fully expose a paper path from a position before register roller 65 to another position before fixing unit 71. Accordingly it becomes easier to remove the OHP sheet by feeding the OHP sheet from the detection position where the recording paper is detected to be the OHP sheet towards the intermediate transfer unit even by a short distance. Therefore a feeding amount (the number of pulses if there is provided a pulse motor) is predetermined that is required for feeding the sheet from the detection position to a position immediately before the position where an image is transferred, and the she et is fed by the aforementioned feeding amount at step S501.

When printer engine controller 12 finishes feeding the sheet to the OHP removing position, it transmits OHP removing position feeding completion information to host controller 11 (S502). When host controller 11 receives the OHP removing position feeding completion information from printer engine controller 12 (S400), the controller 11 displays an OHP error and removing instruction on display/operation section 17, and thereby notifies an operator that an error due to the OHP sheet occurs and that the OHP sheet should be removed. The operator looking at the error display opens a cover at the position where the OHP sheet is lying, and exposes the paper path to remove the OHP sheet.

Meanwhile, after transmitting the OHP removing position feeding completion information, printer engine controller 12 determines whether or not the OHP sheet waiting at the removing position is removed from the paper path according to the processing of steps S503 to S506. Cover 86 is provided with a door sensor. Checking "ON"/"OFF" of this door sensor enables a condition of the door to be recognized. Accordingly, it is judged that door 86 is opened when the door sensor changes from "ON (closed condition)" to "OFF (opened condition)", while it is judged that door 86 is closed when the sensor changes from "OFF" to "ON".

When door 86 is closed, the controller 12 judges whether or not the OHP sheet is really removed based on a detection signal of OHP detecting sensor 31 (S505). When the OHP sheet waiting at the OHP removing position is certainly removed, OHP detecting sensor 31 does not detect the OHP sheet. After confirming that the OHP sheet is removed, the controller 12 transmits OHP removing information to host controller 11 (S506).

Thereby, until the OHP sheet waiting at the OHP removing position is certainly removed, display/operation section 17 continues to display the OHP error and removing instruction. If an operator incorrectly removes different recording paper waiting on the paper path and performs a reprinting operation, the apparatus is designed not to operate. In particular, in the case of both-side recording, since a plurality of sheets of recording paper are present on paper paths, there is a possibility that different recording paper is removed by operating a different paper jam removing mechanism such as another cover.

When host controller 11 displays the OHP error and removing instruction in the processing of step S401, and then receives the OHP removing information from printer engine controller 12 (S402), the controller 11 changes the display contents on display/operation section 17 from the OHP error and removing instruction to a reprinting operation display (S403). When an operator performs a reprinting instruction operation on display/operation section 17 (S404), host controller 11 transmits an instruction for reprinting the image stored on the intermediate transfer material to printer engine controller 12 (S405).

Thereby, when the recording medium is determined to be an OHP sheet, although the both-side recording is instructed, the recording is not performed on the OHP sheet, which is set to wait at a predetermined position corresponding to cover 86, whereby it is possible to prevent the OHP sheet with oil on a surface thereof from entering again the paper path, and to prevent the occurrence of slipping due to the oil adhering to a surface of a roller. Further, since an OHP sheet is not discharged with only oil coated thereon without any recording performed thereon, it is possible to prevent the OHP sheet that is not reusable from being wastefully used.

Printer engine controller 12 instructs belt transfer control block 24 so that an image scheduled to be transferred to an OHP sheet from the intermediate transfer material is stored until the OHP sheet is removed and reprinting is instructed. Then the controller 12 receives the instruction for reprinting the image stored on the intermediate transfer material from host controller 11 (S507), the controller 12 starts the control for printing the image stored on the intermediate transfer material (which is the image scheduled to be transferred to the OHP sheet) (S508). According to this reprinting control, the image scheduled to be transferred to the OHP sheet is transferred and fixed to newly fed recording paper, and the paper is passed through main body side discharge sensor 33, and discharged outside the apparatus from top unit 54. When printer engine controller 12 confirms that the recording paper is detected by main body side discharge sensor 33 and discharged outside the apparatus (S509), the controller 12 transmits the discharge completion information to host controller 11 (S510), and stops the control for reprinting the image stored on the intermediate transfer material (S511).

After stopping the control for reprinting the image stored on the intermediate transfer material, when there is a printing request for another page, the controller 12 shifts its processing flow to the step S207 in FIG. 6, and requests host controller 11 to transmit image data. The controller 12 repeats the same processing until there is no page to be processed, and stops all the printing controls when there is no page (S513).

In addition, when the recording paper is not discharged after a predetermined time elapses in the processing of step S509 (S514), the controller 12 performs the error processing (S515), and transmits the printer engine error information to host controller 11 (S516).

Thus, even when an OHP sheet is used incorrectly as a recording medium, a color image is stored on the intermediate transfer material until the reprinting instruction is performed, whereby it is possible to transfer the color image to a recording medium fed next without forming again the same color image on the intermediate transfer material. As a result, it is possible to perform the reprinting speedy and efficiently after the OHP sheet is removed.

(Third Embodiment)

A color recording apparatus according to this embodiment has the same constitution as that of the color recording apparatus in the first embodiment with expectation that it performs different control contents at the time an OHP both-side detection error occurs. The same reference numerals as those in the first embodiment are used for the same components and processing steps as those in the first embodiment.

The apparatus in this embodiment is designed to be capable of coping with a case that different recording paper is removed incorrectly from the both-side unit despite an OHP sheet being set to wait at a position before the transfer unit.

Figure 18:
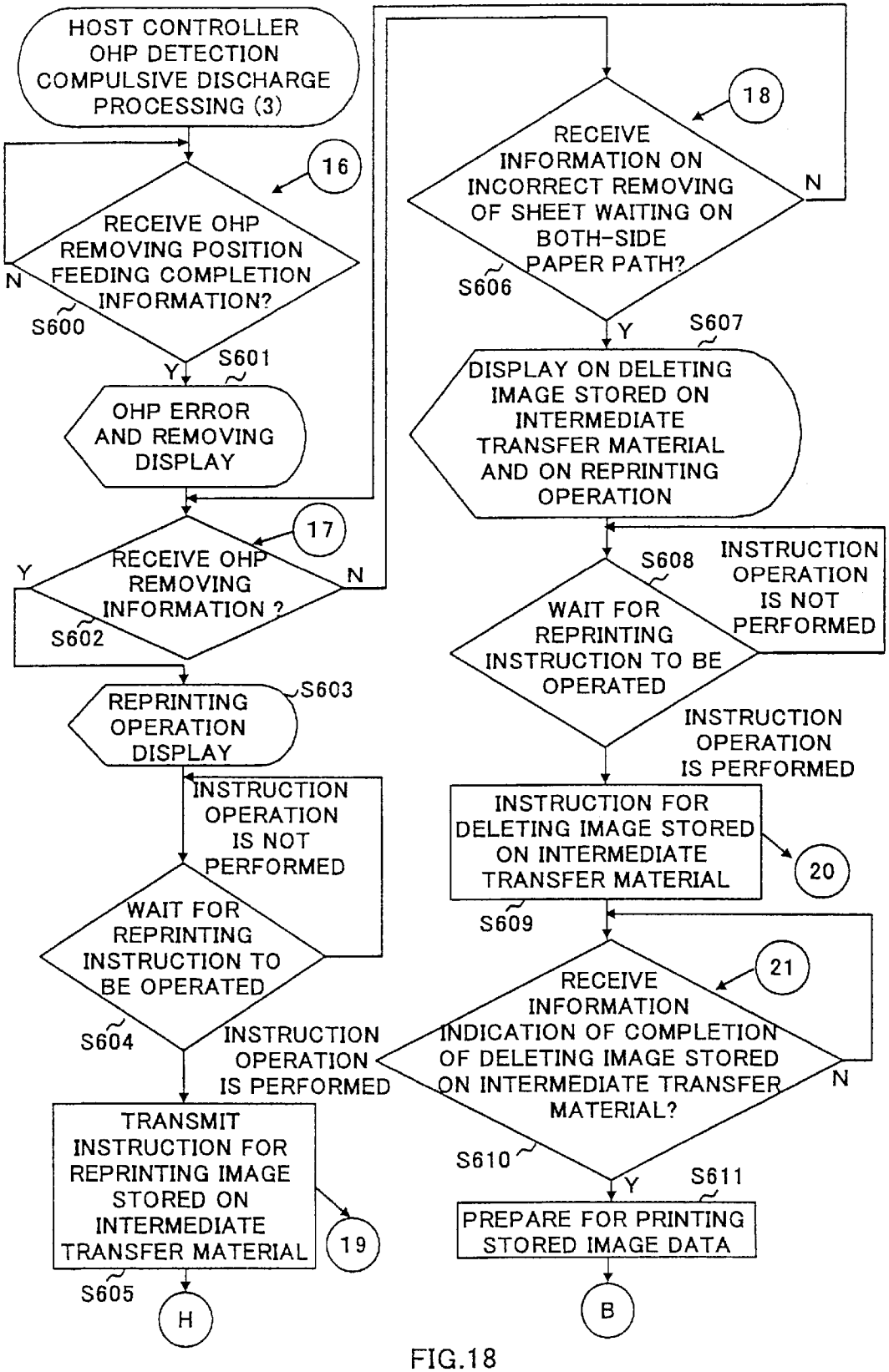
FIG. 18 is a flow diagram of OHP detection compulsive discharge processing in a host controller in a third embodiment.
Figure 19:
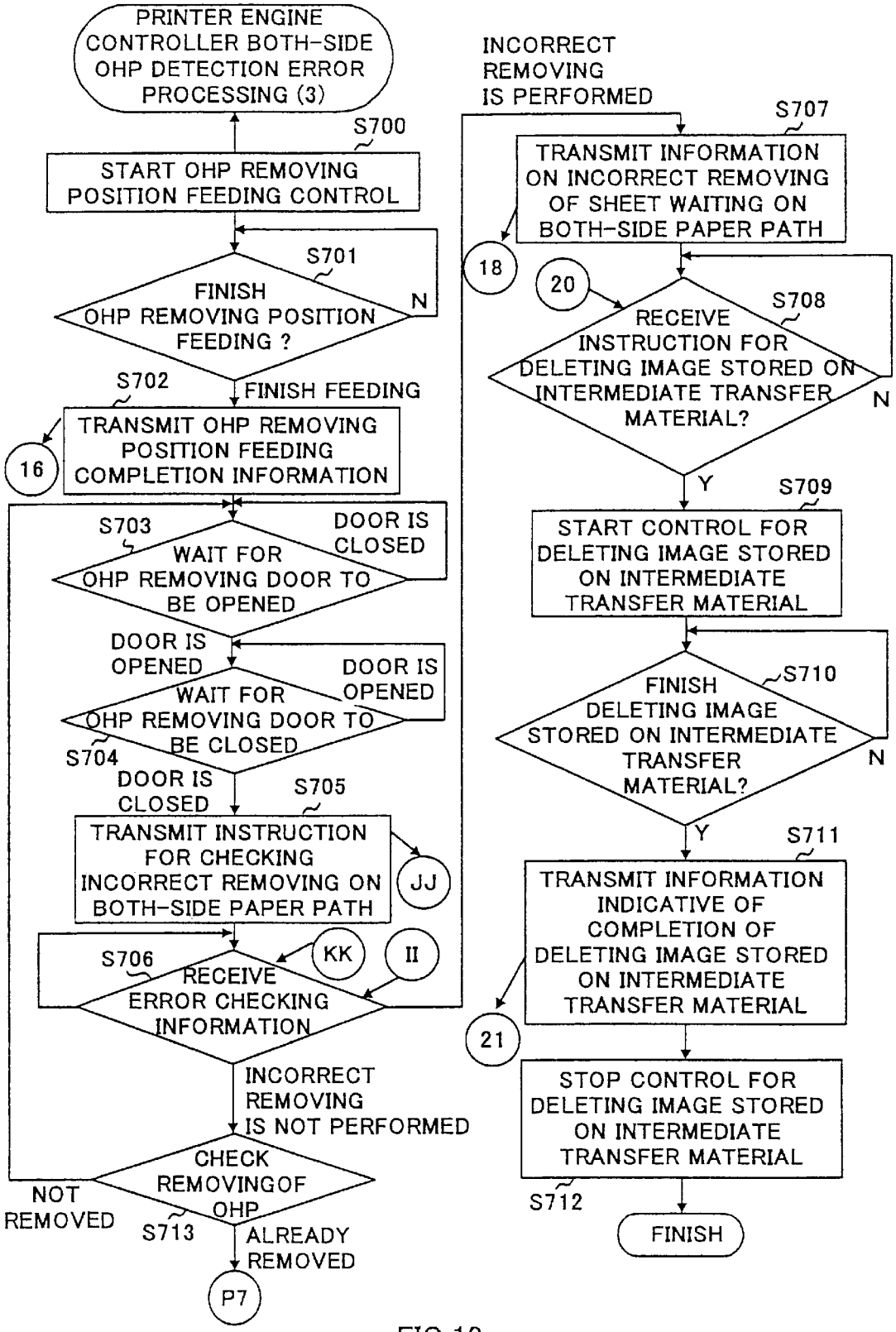
FIG. 19 is a flow diagram of first half of both-side OHP detection error processing in a printer engine controller in the third embodiment.
Figure 20:
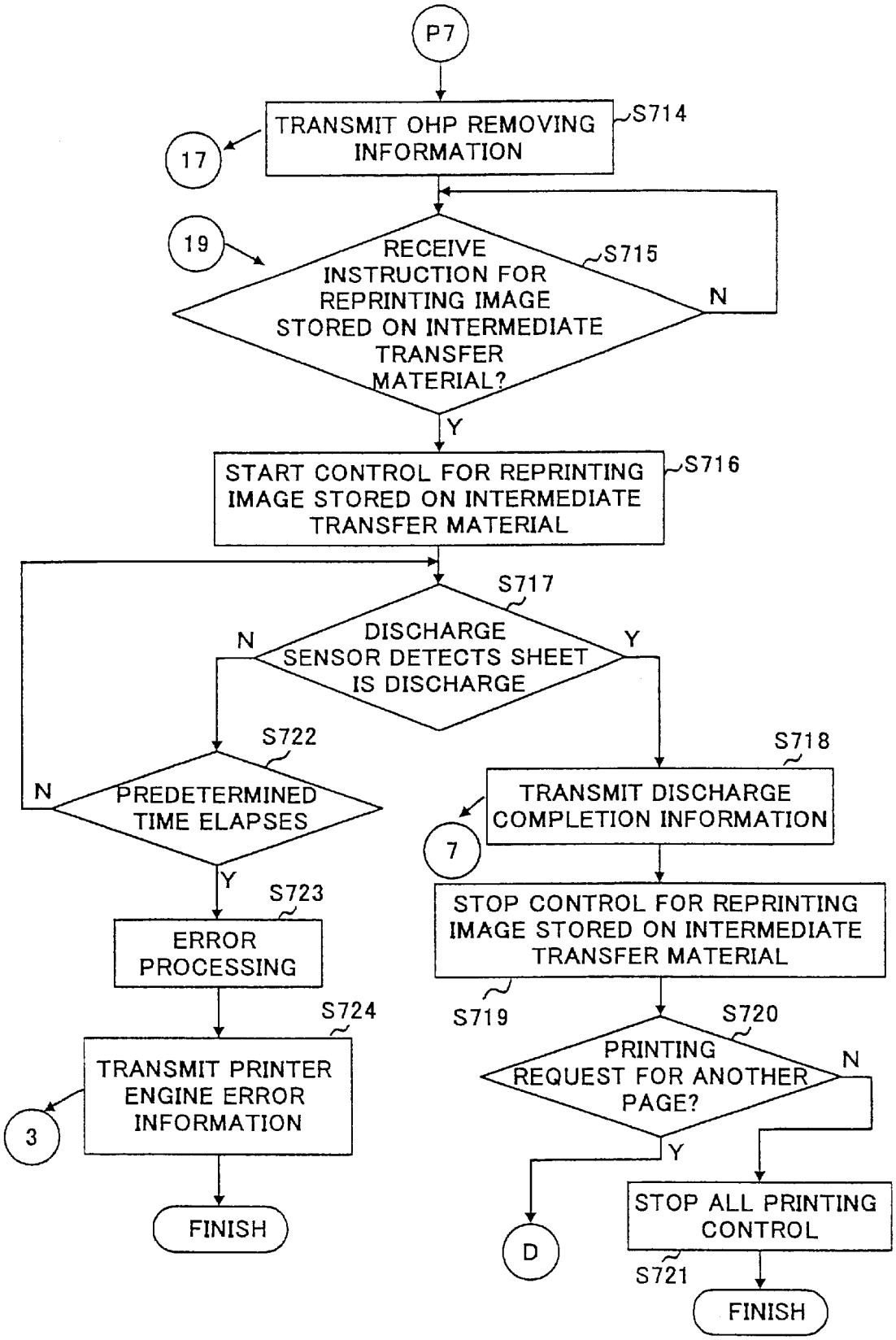
FIG. 20 is a flow diagram of latter half of the both-side OHP detection error processing in the printer engine controller in the third embodiment.
Figure 21:
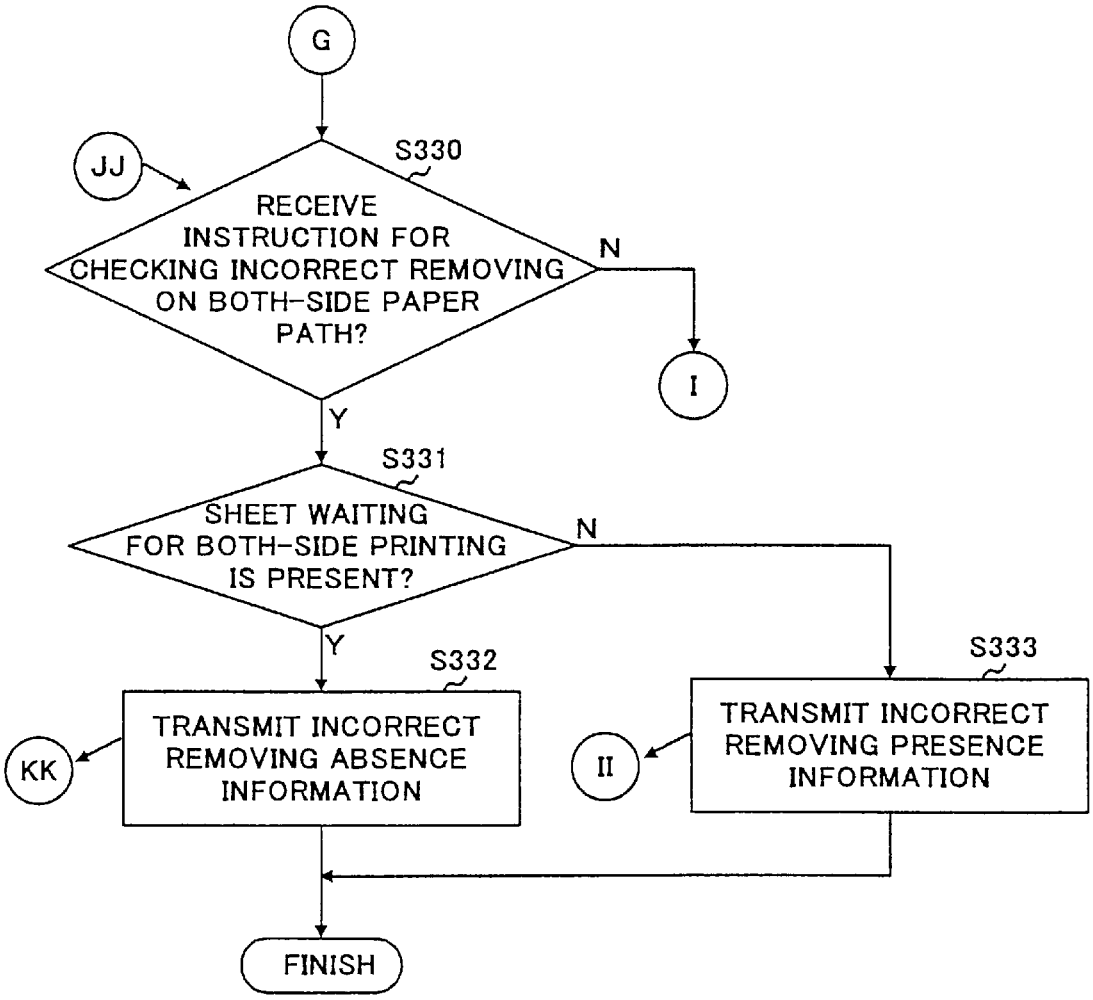
FIG. 21 is a flow diagram of incorrect removing checking in a both-side unit controller in the third embodiment.

FIG. 18 is a flowchart of OHP detection compulsive discharge processing performed by host controller 11, and FIGS. 19 and 20 are flowcharts of both-side OHP detection error processing performed by printer engine controller 12. Further, FIG. 21 is a flowchart of processing regarding incorrect removing performed by both-side unit controller 13.

When printer engine controller 12 detects that recording paper is an OHP sheet at the time the both-side recording is instructed in the processing of step S213 as described above, the controller 12 performs the both-side OHP detection error processing (S245).

In the both-side OHP detection error processing in this embodiment, the processing flow (S700 to S704) from starting the feeding control to feed the OHP sheet to the OHP removing position to closing cover 86 is the same as in the second embodiment.

After setting the OHP sheet to wait at the OHP removing position, printer engine controller 12 confirms that cover 86 that is once opened is closed, and then transmits an instruction for checking incorrect removing on the both-side paper path to both-side unit controller 13 (S705).

When both-side unit controller 13 receives the instruction for checking incorrect removing on the both-side paper path (S330), the controller 13 judges whether or not there is present recording paper waiting on the paper path in the both-side unit (S331). Since sensors 40 to 43 each for detecting a passage are provided on the paper path in the both-side unit, checking detection signals from these sensors enables the controller 13 to judge whether or not the recording paper waiting in the both-side unit is incorrectly removed. As a result of the judgment at the step S331, when recording paper is not removed incorrectly, the controller 13 transmits incorrect removing absence information to printer engine controller 12 (S332). When it is confirmed that recording paper is incorrectly removed, the controller 13 transmits incorrect removing presence information to printer engine controller 12 (S333).

When printer engine controller 12 receives the incorrect removing absence information from both-side unit controller 13 as error checking information (S706), the controller 12 shifts its processing flow to step S713 to check the removing of OHP sheet. Then, the controller 12 transmits the OHP removing information (S714), receives the instruction for reprinting the image stored on the intermediate transfer material (S715), and performs the reprinting control (S716). When the recording paper with the reprinted image is discharged (S717), the controller 12 transmits the discharge completion information (S718), stops the reprinting control (S719), and requests image data when there is a printing request for a next page (S720), while stopping the printing control when there is no request for a next page (S721).

Meanwhile, printer engine controller 12 receives the incorrect removing presence information from both-side unit controller 13 as the error checking information (S706), the controller 12 shifts its processing flow to step S707, and transmits information on incorrect removing of sheet waiting on the both-side paper path to host controller 11.

When host controller 11 receives the OHP removing position feeding completion information (S600), it displays the OHP error and removing instruction on display/operation panel 17 in the same way as in the second embodiment (S601). Thereafter, when the controller 11 receives the OHP removing information from printer engine controller 12 (S602), the controller 11 displays the reprinting operation instruction in the same way as in the second embodiment (S603). When the reprinting instruction is performed (S604), the controller 11 transmits the instruction for reprinting the image stored on the intermediate transfer material (S605).

Meanwhile, when the controller 11 receives the information on incorrect removing of sheet waiting on the both-side paper path, not the OHP removing information, at step S602 (S606), the controller 11 changes the display contents of display/operation section 17 from the OHP error and removing instruction to the contents indicative of deleting the image stored on the intermediate transfer material and reprinting operation (S607). When an operator inputs a reprinting instruction (S608), the controller 11 transmits an instruction for deleting the image stored on the intermediate transfer material to printer engine controller 12 (S609).

When printer engine controller 12 receives the instruction for deleting the image stored on the intermediate transfer material in response to the information on incorrect removing of sheet waiting on the both-side paper path transmitted to host controller 11 (S708), the controller 12 instructs belt transfer control block 24 to perform the control for deleting the image stored on the intermediate transfer material (S709). After the operation is finished that deletes the image stored on the intermediate transfer material, the controller 12 transmits information indicative of completion of deleting the image stored on the intermediate transfer material (S711), and stops the control for deleting the image stored on the intermediate transfer material (S712).

When host controller 11 receives the information indicative of completion of deleting the image stored on the intermediate transfer material in response to the instruction for deleting the image stored on the intermediate transfer material transmitted to printer engine controller 12 at the step S609 (S610), the controller 11 performs a preparation for reprinting using image data of the deleted image stored in image memory 16 (S611). Then the controller 11 shifts its processing flow to the step S103, and transmits a request for printing first image data to be re-recorded to printer engine controller 12.

Thereby, in the case where recording paper present on the paper path in the both-side unit is incorrectly removed at the time the both-side OHP detection error occurs, a color image stored on the intermediate transfer material is deleted, whereby the color image is formed again on the intermediate transfer material according to the order to restart printing under a condition that the recording paper with an image recorded on one-side thereof is also removed from the paper path. As a result, it is possible to prevent images for one side and the other side for each page from being recorded on different recording media with the sides inverted and/or the order disordered, and to prevent recording media with unnecessary images recorded thereon from being wastefully consumed.

The present invention is not limited to the above described embodiments, and various variations and modifications may be possible without departing from the scope of the present invention.

This application is based on the Japanese Patent Application No.HEI11-313466 filed on Nov. 4, 1999, entire content of which is expressly incorporated by reference herein.

What is claimed is:

1. A recording apparatus comprising:

an input section that is used for inputting an instruction to perform both-side recording for recording an image on both sides of a recording medium;

a determining section configured to determine whether the recording medium is a water-repellent sheet; and a controller configured to compulsively discharge the recording medium when the both-side recording is instructed and said determining section determines that the recording medium to be subjected to current image recording is the water-repellent sheet.

2. The recording apparatus according to claim 1, wherein said controller compulsively discharges the recording medium that is the water-repellent sheet after recording the image on one side of the recording medium.

3. The recording apparatus according to claim 1, further comprising:

a feeding mechanism that circulates a plurality of recording medium on a paper path to pass through a fixing unit in a predetermined order when the both-side recording is instructed, wherein said controller compulsively discharges all the recording medium on a paper path when the water-repellent sheet as the recording medium is compulsively discharged.

4. The recording apparatus according to claim 1, wherein said controller continues to store digital image data of the image to be recorded on the recording medium that is compulsively discharged when said controller compulsively discharges the recording medium, while deleting the digital image data of the image recorded on the recording medium that is discharged when said controller normally discharges the recording medium.

5. The recording apparatus according to claim 1, wherein said determining section has a sensor that detects that the recording medium passes through a predetermined position on a paper path, and a transmission sensor that detects the recording medium that passes through the predetermined position.

6. A recording apparatus comprising:

an input section that is used for inputting an instruction to perform both-side recording for recording an image on both sides of a recording medium;

a determining section configured to determine whether the recording medium is a water-repellent sheet; and a controller configured to set the recording medium to wait at a predetermined position before an image transferred on the recording medium when the both-side recording is instructed-and said determining section determines that the recording medium to be subjected to current image recording is the water-repellent sheet.

7. The recording apparatus according to claim 6, wherein said recording medium is set to wait at a position corresponding to a cover for removing paper jam.

8. A recording apparatus comprising:

a recording section that forms a color image on an intermediate transfer material and transfers the color image from the intermediate transfer material to a recording medium;

an input section used for inputting an instruction to perform both-side recording for recording an image on both sides of the recording medium;

a determining section configured to determine whether the recording medium is a water-repellent sheet; and a controller configured to set the recording medium to wait at a predetermined position before an image transferred on the recording medium when the both-side recording is instructed and said determining section determines that the recording medium to be subjected to current image recording is the water-repellent sheet, wherein the color image is still holed on the intermediate transfer material after the recording medium waiting at the predetermined position is removed, and the color image is transferred to another recording medium that is provided to said recording section after the recording medium is removed.

9. The recording apparatus according to claim 8, further comprising:

a feeding mechanism circulates a plurality of recording medium on a paper path to pass through a fixing unit in a predetermined order when the both-side recording is instructed, wherein the color image hold on the intermediate transfer material is deleted after the recording medium waiting at the predetermined position is removed and further one or more remaining other recording mediums on the paper path are removed.

10. A recording method, comprising:

detecting an instruction to perform both-side recording for recording an image on both sides of a recording medium;

determining whether the recording medium is a water-repellent sheet; and compulsively discharging the recording medium when the both-side recording is instructed and the recording medium to be subjected to current image recording is determined to be the water-repellent sheet.

11. A recording method, comprising:

detecting an instruction to perform both-side recording for recording an image on both sides of a recording medium;

determining whether the recording medium is a water-repellent sheet; and setting the recording medium to wait at a predetermined position before image transferred on the recording medium when the both-side recording is instructed and the recording medium to be subjected to current image recording is determined to be the water-repellent sheet.

* * * * *